US009297614B2

(12) United States Patent
Moore

(10) Patent No.: US 9,297,614 B2
(45) Date of Patent: Mar. 29, 2016

(54) MASTER MODULE LIGHT SOURCE, RETAINER AND KITS

(71) Applicant: Larry E. Moore, Cottonwood, AZ (US)

(72) Inventor: Larry E. Moore, Cottonwood, AZ (US)

( * ) Notice: Subject to any disclaimer, the term of this patent is extended or adjusted under 35 U.S.C. 154(b) by 0 days.

(21) Appl. No.: 14/459,274

(22) Filed: Aug. 13, 2014

(65) Prior Publication Data

US 2015/0192391 A1 Jul. 9, 2015

Related U.S. Application Data

(60) Provisional application No. 61/865,602, filed on Aug. 13, 2013.

(51) Int. Cl.
*F41G 1/35* (2006.01)

(52) U.S. Cl.
CPC ..... *F41G 1/35* (2013.01)

(58) Field of Classification Search
CPC ..... F41G 11/003; F41G 11/001; F41G 11/00; F41G 1/35; F41C 33/0254; F41A 33/02; F21V 23/04; F21V 23/06; G02B 27/20
USPC ..... 42/117
See application file for complete search history.

(56) References Cited

U.S. PATENT DOCUMENTS

| | | | |
|---|---|---|---|
| 1,898,566 | A | 2/1933 | Noel |
| 2,268,056 | A | 12/1941 | Nelson et al. |
| 2,357,951 | A | 9/1944 | Hale |
| 2,430,469 | A | 11/1947 | Karnes |
| 2,597,565 | A | 5/1952 | Chandler et al. |
| 2,773,309 | A | 12/1956 | Elliot |
| 2,780,882 | A | 2/1957 | Temple |
| 2,826,848 | A | 3/1958 | Davies |
| 2,844,710 | A | 7/1958 | Rudolf |
| 2,904,888 | A | 9/1959 | Niesp |
| 3,112,567 | A | 12/1963 | Flanagan |
| 3,192,915 | A | 7/1965 | Norris et al. |
| 3,284,905 | A | 11/1966 | Simmons |
| 3,510,965 | A | 5/1970 | Rhea |
| 3,526,972 | A | 9/1970 | Sumpf |
| 3,573,868 | A | 4/1971 | Giannetti |
| 3,641,676 | A | 2/1972 | Knutsen et al. |
| 3,645,635 | A | 2/1972 | Steck |
| 3,801,205 | A | 4/1974 | Eggenschwyler |
| 3,914,873 | A | 10/1975 | Elliott, Jr. et al. |
| 3,992,783 | A | 11/1976 | Dunlap et al. |
| 3,995,376 | A | 12/1976 | Kimble et al. |
| 4,026,054 | A | 5/1977 | Snyder |
| 4,079,534 | A | 3/1978 | Snyder |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

EPO; Office Action dated Oct. 5, 2011 in Serial No. 09169459.

(Continued)

*Primary Examiner* — Joshua Freeman
*Assistant Examiner* — Bridget Cochran
(74) *Attorney, Agent, or Firm* — Snell & Wilmer LLP

(57) ABSTRACT

A master module incorporates a laser, a power source, a control unit and a laser adjustment mechanism. The module is a single, compact unit designed to fit into a small casing.

20 Claims, 18 Drawing Sheets

(56) References Cited

U.S. PATENT DOCUMENTS 4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,348,828 A 9/1982 Snyder
4,352,665 A 10/1982 Kimble et al.
4,481,561 A 11/1984 Lanning
4,488,369 A 12/1984 Van Note
4,541,191 A 9/1985 Morris et al.
4,567,810 A 2/1986 Preston
4,713,889 A 12/1987 Santiago
4,763,431 A 8/1988 Allan et al.
4,825,258 A 4/1989 Whitson
4,830,617 A 5/1989 Hancox et al.
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,177,309 A 1/1993 Willoughby et al.
5,178,265 A 1/1993 Sepke
5,179,124 A 1/1993 Schoenwald et al.
5,179,235 A 1/1993 Toole
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,481,819 A 1/1996 Teetzel
5,488,795 A 2/1996 Sweat
D368,121 S 3/1996 Lam
5,499,455 A 3/1996 Palmer
5,509,226 A 4/1996 Houde-Walter
5,515,636 A 5/1996 McGarry et al.
5,531,040 A 7/1996 Moore
5,555,662 A 9/1996 Teetzel
5,557,872 A 9/1996 Langner
5,566,459 A 10/1996 Breda
5,581,898 A * 12/1996 Thummel ..... F41G 1/35 42/114
5,584,137 A 12/1996 Teetzel
5,590,486 A 1/1997 Moore
5,598,958 A 2/1997 Ryan, III et al.
5,618,099 A 4/1997 Brubacher
5,621,999 A 4/1997 Moore
5,622,000 A 4/1997 Marlowe
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,735,070 A 4/1998 Vasquez et al.
5,787,631 A 8/1998 Kendall
5,788,500 A 8/1998 Gerber
5,822,905 A 10/1998 Teetzel
5,842,300 A 12/1998 Cheshelski et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,289,624 B1 9/2001 Hughes et al.
6,293,869 B1 9/2001 Kwan
6,295,753 B1 10/2001 Thummel
6,301,046 B1 10/2001 Tai et al.
6,318,228 B1 11/2001 Thompson
6,327,806 B1 12/2001 Paige
6,345,464 B1 2/2002 Kim et al.
6,363,648 B1 4/2002 Kranich et al.
6,366,349 B1 4/2002 Houde-Walter
6,371,004 B1 4/2002 Peterson
6,385,893 B1 5/2002 Cheng
6,389,729 B2 5/2002 Rauch et al.
6,389,730 B1 5/2002 Millard
6,397,509 B1 6/2002 Langner
6,430,861 B1 8/2002 Ayers et al.
6,434,874 B1 8/2002 Hines
6,442,880 B1 9/2002 Allan
6,487,807 B1 12/2002 Kopman et al.
6,499,247 B1 12/2002 Peterson
6,526,688 B1 3/2003 Danielson et al.
6,568,118 B1 5/2003 Teetzel
6,572,375 B2 6/2003 Shechter et al.
6,575,753 B2 6/2003 Rosa et al.
6,578,311 B2 6/2003 Danielson et al.
6,579,098 B2 6/2003 Shechter
6,591,536 B2 7/2003 Houde-Walter et al.
6,606,797 B1 8/2003 Gandy
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
D487,791 S 3/2004 Freed
6,742,299 B2 6/2004 Strand
6,782,789 B2 8/2004 McNulty
6,854,205 B2 2/2005 Wikle et al.
6,931,775 B2 8/2005 Burnett
6,935,864 B2 8/2005 Shechter et al.

(56) References Cited

U.S. PATENT DOCUMENTS

| | | | |
|---|---|---|---|
| 6,966,775 | B1 | 11/2005 | Kendir et al. |
| 7,032,342 | B2 | 4/2006 | Pikielny |
| 7,049,575 | B2 | 5/2006 | Hotelling |
| 7,111,424 | B1 | 9/2006 | Moody et al. |
| 7,121,034 | B2 | 10/2006 | Keng |
| 7,134,234 | B1 | 11/2006 | Makarounis |
| 7,191,557 | B2 | 3/2007 | Gablowski et al. |
| D542,446 | S | 5/2007 | DiCarlo et al. |
| 7,218,501 | B2 | 5/2007 | Keely |
| 7,237,352 | B2 | 7/2007 | Keely et al. |
| 7,243,454 | B1 | 7/2007 | Cahill |
| 7,260,910 | B2 | 8/2007 | Danielson |
| 7,264,369 | B1 | 9/2007 | Howe |
| 7,303,306 | B2 | 12/2007 | Ross et al. |
| 7,305,790 | B2 | 12/2007 | Kay |
| 7,329,127 | B2 | 2/2008 | Kendir et al. |
| 7,331,137 | B2 | 2/2008 | Hsu |
| D567,894 | S | 4/2008 | Sterling et al. |
| 7,360,333 | B2 | 4/2008 | Kim |
| D570,948 | S | 6/2008 | Cerovic et al. |
| RE40,429 | E | 7/2008 | Oliver et al. |
| D578,599 | S | 10/2008 | Cheng |
| 7,441,364 | B2 | 10/2008 | Rogers et al. |
| 7,453,918 | B2 | 11/2008 | Laughman et al. |
| 7,454,858 | B2 | 11/2008 | Griffin |
| 7,464,495 | B2 | 12/2008 | Cahill |
| 7,472,830 | B2 | 1/2009 | Danielson |
| D586,874 | S | 2/2009 | Moody et al. |
| 7,490,429 | B2 | 2/2009 | Moody et al. |
| 7,578,089 | B1 | 8/2009 | Griffin |
| 7,584,569 | B2 | 9/2009 | Kallio |
| 7,591,098 | B2 | 9/2009 | Matthews et al. |
| D602,109 | S | 10/2009 | Cerovic et al. |
| 7,603,997 | B2 | 10/2009 | Hensel et al. |
| D603,478 | S | 11/2009 | Hughes |
| 7,624,528 | B1 | 12/2009 | Bell et al. |
| 7,627,976 | B1 | 12/2009 | Olson |
| 7,644,530 | B2 | 1/2010 | Scherpf |
| 7,652,216 | B2 | 1/2010 | Sharrah et al. |
| D612,756 | S | 3/2010 | D'Amelio et al. |
| D612,757 | S | 3/2010 | D'Amelio et al. |
| 7,674,003 | B2 | 3/2010 | Sharrah et al. |
| 7,676,975 | B2 | 3/2010 | Phillips et al. |
| 7,685,756 | B2 | 3/2010 | Moody et al. |
| 7,698,847 | B2 | 4/2010 | Griffin |
| 7,703,719 | B1 | 4/2010 | Bell et al. |
| 7,712,241 | B2 | 5/2010 | Teetzel et al. |
| D616,957 | S | 6/2010 | Rievley et al. |
| 7,726,059 | B2 | 6/2010 | Pikielny |
| 7,726,061 | B1 | 6/2010 | Thummel |
| 7,730,820 | B2 | 6/2010 | Vice et al. |
| 7,743,546 | B2 | 6/2010 | Keng |
| 7,743,547 | B2 | 6/2010 | Houde-Walter |
| 7,753,549 | B2 | 7/2010 | Solinsky et al. |
| 7,771,077 | B2 | 8/2010 | Miller |
| 7,797,843 | B1 | 9/2010 | Scott et al. |
| 7,805,876 | B1 | 10/2010 | Danielson et al. |
| 7,818,910 | B2 | 10/2010 | Young |
| 7,841,120 | B2 | 11/2010 | Teetzel et al. |
| 7,880,100 | B2 | 2/2011 | Sharrah et al. |
| 7,900,390 | B2 | 3/2011 | Moody et al. |
| 7,913,439 | B2 | 3/2011 | Whaley |
| D636,049 | S | 4/2011 | Hughes et al. |
| D636,837 | S | 4/2011 | Hughes et al. |
| 7,921,591 | B1 | 4/2011 | Adcock |
| 7,926,218 | B2 | 4/2011 | Matthews et al. |
| 7,997,023 | B2 | 8/2011 | Moore et al. |
| 8,006,427 | B2 | 8/2011 | Blevins et al. |
| 8,006,428 | B2 | 8/2011 | Moore et al. |
| 8,028,460 | B2 | 10/2011 | Williams |
| 8,028,461 | B2 | 10/2011 | NuDyke |
| 8,050,307 | B2 | 11/2011 | Day et al. |
| 8,056,277 | B2 | 11/2011 | Griffin |
| 8,093,992 | B2 | 1/2012 | Jancic et al. |
| 8,104,220 | B2 | 1/2012 | Cobb |
| D653,798 | S | 2/2012 | Janice et al. |
| 8,109,024 | B2 | 2/2012 | Abst |
| 8,110,760 | B2 | 2/2012 | Sharrah et al. |
| 8,132,354 | B1 | 3/2012 | Sellers et al. |
| 8,136,284 | B2 | 3/2012 | Moody et al. |
| 8,141,288 | B2 | 3/2012 | Dodd et al. |
| 8,146,282 | B2 | 4/2012 | Cabahug et al. |
| 8,151,504 | B1 | 4/2012 | Aiston |
| 8,151,505 | B2 | 4/2012 | Thompson |
| 8,166,694 | B2 | 5/2012 | Swan |
| 8,172,139 | B1 | 5/2012 | McDonald et al. |
| D661,366 | S | 6/2012 | Zusman |
| 8,196,328 | B2 | 6/2012 | Simpkins |
| 8,215,047 | B2 | 7/2012 | Ash et al. |
| 8,225,542 | B2 | 7/2012 | Houde-Walter |
| 8,225,543 | B2 | 7/2012 | Moody et al. |
| 8,245,428 | B2 | 8/2012 | Griffin |
| 8,245,434 | B2 | 8/2012 | Hogg et al. |
| 8,256,154 | B2 | 9/2012 | Danielson et al. |
| 8,258,416 | B2 | 9/2012 | Sharrah et al. |
| D669,552 | S | 10/2012 | Essig et al. |
| D669,553 | S | 10/2012 | Hughes et al. |
| D669,957 | S | 10/2012 | Hughes et al. |
| D669,958 | S | 10/2012 | Essig et al. |
| D669,959 | S | 10/2012 | Johnston et al. |
| D670,785 | S | 11/2012 | Fitzpatrick et al. |
| 8,312,666 | B2 | 11/2012 | Moore et al. |
| D672,005 | S | 12/2012 | Hedeen et al. |
| 8,322,064 | B2 | 12/2012 | Cabahug et al. |
| 8,335,413 | B2 | 12/2012 | Dromaretsky et al. |
| D674,861 | S | 1/2013 | Johnston et al. |
| D674,862 | S | 1/2013 | Johnston et al. |
| D675,281 | S | 1/2013 | Speroni |
| 8,341,868 | B2 | 1/2013 | Zusman |
| 8,347,541 | B1 | 1/2013 | Thompson |
| 8,356,818 | B2 | 1/2013 | Mraz |
| 8,360,598 | B2 | 1/2013 | Sharrah et al. |
| D676,097 | S | 2/2013 | Izumi |
| 8,365,456 | B1 | 2/2013 | Shepard |
| D677,433 | S | 3/2013 | Swan et al. |
| D678,976 | S | 3/2013 | Pittman |
| 8,387,294 | B2 | 3/2013 | Bolden |
| 8,393,104 | B1 | 3/2013 | Moody et al. |
| 8,393,105 | B1 | 3/2013 | Thummel |
| 8,397,418 | B2 | 3/2013 | Cabahug et al. |
| 8,402,683 | B2 | 3/2013 | Cabahug et al. |
| 8,413,362 | B2 | 4/2013 | Houde-Walter |
| D682,977 | S | 5/2013 | Thummel et al. |
| 8,443,539 | B2 | 5/2013 | Cabahug et al. |
| 8,444,291 | B2 | 5/2013 | Swan et al. |
| 8,448,368 | B2 | 5/2013 | Cabahug et al. |
| 8,458,944 | B2 | 6/2013 | Houde-Walter |
| 8,467,430 | B2 | 6/2013 | Caffey et al. |
| 8,468,734 | B2 | 6/2013 | Meller et al. |
| 8,468,930 | B1 | 6/2013 | Bell |
| D687,120 | S | 7/2013 | Hughes et al. |
| 8,480,329 | B2 | 7/2013 | Fluhr et al. |
| 8,484,880 | B1 | 7/2013 | Sellers et al. |
| 8,484,882 | B2 | 7/2013 | Haley et al. |
| 8,485,686 | B2 | 7/2013 | Swan et al. |
| 8,510,981 | B1 | 8/2013 | Ganther et al. |
| 8,516,731 | B2 | 8/2013 | Cabahug et al. |
| 8,567,981 | B2 | 10/2013 | Finnegan et al. |
| 8,584,587 | B2 | 11/2013 | Uhr |
| D697,162 | S | 1/2014 | Faifer |
| 8,661,725 | B1 | 3/2014 | Ganther et al. |
| 8,734,156 | B2 | 5/2014 | Uhr |
| 8,739,447 | B2 | 6/2014 | Merritt et al. |
| 8,844,189 | B2 | 9/2014 | Moore et al. |
| 8,919,023 | B2 | 12/2014 | Merritt et al. |
| 8,938,904 | B1 | 1/2015 | Sellers et al. |
| 8,944,838 | B2 | 2/2015 | Mulfinger |
| 2001/0042335 | A1 | 11/2001 | Strand |
| 2002/0009694 | A1 | 1/2002 | Rosa |
| 2002/0051953 | A1 | 5/2002 | Clark et al. |
| 2002/0057719 | A1 | 5/2002 | Shechter |
| 2002/0073561 | A1 | 6/2002 | Liao |
| 2002/0129536 | A1 | 9/2002 | Iafrate et al. |
| 2002/0134000 | A1 | 9/2002 | Varshneya et al. |

(56) References Cited

U.S. PATENT DOCUMENTS

| | | | |
|---|---|---|---|
| 2002/0194767 | A1 | 12/2002 | Houde-Walter et al. |
| 2003/0003424 | A1 | 1/2003 | Shechter et al. |
| 2003/0029072 | A1 | 2/2003 | Danielson |
| 2003/0175661 | A1 | 9/2003 | Shechter et al. |
| 2003/0180692 | A1 | 9/2003 | Skala et al. |
| 2003/0196366 | A1 | 10/2003 | Beretta |
| 2004/0003529 | A1 | 1/2004 | Danielson |
| 2004/0010956 | A1 | 1/2004 | Bubits |
| 2004/0014010 | A1 | 1/2004 | Swensen et al. |
| 2005/0044736 | A1 | 3/2005 | Liao |
| 2005/0153262 | A1 | 7/2005 | Kendir |
| 2005/0185403 | A1 | 8/2005 | Diehl |
| 2005/0188588 | A1 | 9/2005 | Keng |
| 2005/0241209 | A1 | 11/2005 | Staley |
| 2005/0257415 | A1 | 11/2005 | Solinsky et al. |
| 2005/0268519 | A1 | 12/2005 | Pikielny |
| 2006/0162225 | A1 | 7/2006 | Danielson |
| 2006/0191183 | A1 | 8/2006 | Griffin |
| 2007/0039226 | A1 | 2/2007 | Stokes |
| 2007/0041418 | A1 | 2/2007 | Laughman et al. |
| 2007/0056203 | A1 | 3/2007 | Gering et al. |
| 2007/0113460 | A1 | 5/2007 | Potterfield et al. |
| 2007/0190495 | A1 | 8/2007 | Kendir et al. |
| 2007/0258236 | A1 | 11/2007 | Miller |
| 2007/0271832 | A1 | 11/2007 | Griffin |
| 2008/0000133 | A1 | 1/2008 | Solinsky et al. |
| 2008/0060248 | A1 | 3/2008 | Pine et al. |
| 2008/0134562 | A1 | 6/2008 | Teetzel |
| 2009/0013580 | A1 | 1/2009 | Houde-Walter |
| 2009/0013581 | A1 | 1/2009 | LoRocco |
| 2009/0178325 | A1 | 7/2009 | Veilleux |
| 2009/0183416 | A1 | 7/2009 | Danielson |
| 2009/0293335 | A1 | 12/2009 | Danielson |
| 2009/0293855 | A1 | 12/2009 | Danielson |
| 2010/0058640 | A1 | 3/2010 | Moore et al. |
| 2010/0162610 | A1 | 7/2010 | Moore et al. |
| 2010/0175297 | A1 | 7/2010 | Speroni |
| 2010/0229448 | A1 | 9/2010 | Houde-Walter |
| 2010/0275496 | A1 | 11/2010 | Solinsky et al. |
| 2011/0047850 | A1 | 3/2011 | Rievley et al. |
| 2011/0061283 | A1 | 3/2011 | Cavallo |
| 2011/0162249 | A1 | 7/2011 | Woodmansee et al. |
| 2011/0185619 | A1 | 8/2011 | Finnegan et al. |
| 2012/0047787 | A1 | 3/2012 | Curry |
| 2012/0055061 | A1 | 3/2012 | Hartley et al. |
| 2012/0110886 | A1 | 5/2012 | Moore et al. |
| 2012/0124885 | A1 | 5/2012 | Caulk et al. |
| 2012/0180366 | A1 | 7/2012 | Jaroh et al. |
| 2012/0180367 | A1 | 7/2012 | Singh |
| 2012/0180370 | A1 | 7/2012 | McKinley |
| 2012/0224357 | A1 | 9/2012 | Moore |
| 2013/0185982 | A1 | 7/2013 | Hilbourne et al. |
| 2013/0263492 | A1 | 10/2013 | Erdle |
| 2014/0109457 | A1 | 4/2014 | Speroni |

OTHER PUBLICATIONS

EPO; Office Action dated Oct. 5, 2011 in Serial No. 09169469.
EPO; Office Action dated Dec. 20, 2011 in Application No. 09169476.
EPO; Office Action dated Sep. 3, 2012 in U.S. Appl. No. 09/169,469.
EPO; Office Action dated Sep. 3, 2012 in U.S. Appl. No. 09/169,476.
EPO; Office Action dated Sep. 3, 2012 in U.S. Appl. No. 09/169,459.
EPO; Search Opinion and Report dated Aug. 6, 2010 in U.S. Appl. No. 09/169,459.
EPO; Search Opinion and Report dated Aug. 6, 2010 in U.S. Appl. No. 09/69,469.
EPO; Search Opinion and Report dated Aug. 23, 2010 in U.S. Appl. No. 09/169,476.
EPO; Search Report and Opinion dated Aug. 6, 2012 in U.S. Appl. No. 11/151,504.
USPTO; Advisory Action dated Aug. 22, 2011 in U.S. Appl. No. 12/249,781.
USPTO; Advisory Action dated Jul. 13, 2012 in U.S. Appl. No. 12/249,781.
USPTO; Final Office Action dated Feb. 24, 2010 in U.S. Appl. No. 11/317,647.
USPTO; Final Office Action dated Mar. 6, 2012 in U.S. Appl. No. 12/610,213.
USPTO; Final Office Action dated May 2, 2012 in U.S. Appl. No. 12/249,781.
USPTO; Final Office Action dated Jun. 19, 2009 in U.S. Appl. No. 11/317,647.
USPTO; Final Office Action dated May 18, 2011 in U.S. Appl. No. 12/249,781.
USPTO; Final Office Action dated Aug. 7, 2012 in U.S. Appl. No. 12/249,781.
USPTO; Notice of Allowance dated Feb. 2, 2011 in U.S. Appl. No. 12/249,794.
USPTO; Notice of Allowance dated Feb. 26, 2002 in U.S. Appl. No. 09/624,124.
USPTO; Notice of Allowance dated Mar. 3, 2011 in U.S. Appl. No. 12/249,785.
USPTO; Notice of Allowance dated May 13, 2011 in U.S. Appl. No. 12/249,785.
USPTO; Notice of Allowance dated May 17, 2011 in U.S. Appl. No. 13/077,861.
USPTO; Notice of Allowance dated Jul. 8, 2011 in U.S. Appl. No. 12/249,794.
USPTO; Notice of Allowance dated Sep. 1, 2011 in U.S. Appl. No. 13/077,861.
USPTO; Notice of Allowance dated Nov. 1, 2011 in U.S. Appl. No. 13/077,875.
USPTO; Notice of Allowance dated Nov. 18, 2011 in U.S. Appl. No. 13/077,861.
USPTO; Notice of Allowance dated Jul. 25, 2012 in U.S. Appl. No. 12/610,213.
USPTO; Notice of Allowance dated Aug. 16, 2012 in U.S. Appl. No. 13/346,621.
USPTO; Office Action dated Jan. 26, 2012 in U.S. Appl. No. 12/249,781.
USPTO; Office Action dated Sep. 28, 2009 in U.S. Appl. No. 11/317,647.
USPTO; Office Action dated Oct. 6, 2010 in U.S. Appl. No. 12/249,794.
USPTO; Office Action dated Oct. 18, 2011 in U.S. Appl. No. 12/610,213.
USPTO; Office Action dated Nov. 8, 2010 in U.S. Appl. No. 12/249,781.
USPTO; Office Action dated Dec. 26, 2008 in U.S. Appl. No. 11/317,647.
USPTO; Office Action dated Jun. 11, 2001 in U.S. Appl. No. 09/624,124.
USPTO; Office Action dated Jun. 22, 2011 in U.S. Appl. No. 13/077,875.
USPTO; Office Action dated Nov. 15, 2012 in U.S. Appl. No. 13/412,385.
USPTO; Office Action dated Feb. 1, 2013 in U.S. Appl. No. 12/249,781.
USPTO; Office Action dated Feb. 20, 2013 in U.S. Appl. No. 13/670,278.
USPTO; Office Action dated Mar. 26, 2013 in U.S. Appl. No. 13/353,241.
USPTO; Final Office Action dated Sep. 24, 2013 in U.S. Appl. No. 13/353,241.
USPTO; Office Action dated Jan. 31, 2014 in U.S. Appl. No. 13/353,241.
USPTO; Final Office Action dated Sep. 10, 2014 in U.S. Appl. No. 13/353,241.
USPTO; Office Action dated Oct. 23, 2012 in U.S. Appl. No. 13/010,649.
USPTO; Final Office Action dated Apr. 11, 2013 in U.S. Appl. No. 13/010,649.
USPTO; Final Office Action dated May 16, 2013 in U.S. Appl. No. 13/412,385.
USPTO; Office Action dated Jun. 17, 2013 in U.S. Appl. No. 13/353,301.

(56) References Cited

OTHER PUBLICATIONS

USPTO; Notice of Allowance dated Jan. 18, 2012 in U.S. Appl. No. 13/353,301.
USPTO; Office Action dated Jun. 19, 2013 in U.S. Appl. No. 13/353,165.
USPTO; Final Office Action dated Jul. 29, 2014 in U.S. Appl. No. 13/353,165.
USPTO; Office Action dated Nov. 20, 2014 in U.S. Appl. No. 13/353,165.
USPTO; Final Office Action dated Jun. 24, 2013 in U.S. Appl. No. 13/670,278.
USPTO; Office Action dated Dec. 11, 2013 in U.S. Appl. No. 13/670,278.
USPTO; Notice of Allowance dated Apr. 25, 2014 in U.S. Appl. No. 13/670,278.
USPTO; Notice of Allowance dated Jul. 15, 2013 in U.S. Appl. No. 13/412,385.
USPTO; Office Action dated Nov. 4, 2013 in U.S. Appl. No. 13/412,385.
USPTO; Final Office Action dated Mar. 27, 2014 in U.S. Appl. No. 13/412,385.
USPTO; Office Action dated Sep. 30, 2014 in U.S. Appl. No. 13/412,385.
USPTO; Notice of Allowance dated Aug. 6, 2013 in U.S. Appl. No. 13/010,649.
USPTO; Notice of Allowance dated Jul. 22, 2013 in U.S. Appl. No. 12/249,781.
USPTO; Decision on Appeal dated Aug. 20, 2013 in U.S. Appl. No. 11/317,647.
USPTO; Office Action dated Jan. 27, 2014 in U.S. Appl. No. 13/707,312.
USPTO; Notice of Allowance dated Jun. 11, 2014 in U.S. Appl. No. 13/707,312.
USPTO; Office Action dated Aug. 19, 2014 in U.S. Appl. No. 14/316,688.
USPTO; Final Office Action dated Jan. 27, 2015 in U.S. Appl. No. 14/316,688.
USPTO; Office Action dated Mar. 3, 2015 in U.S. Appl. No. 14/278,315.
Webpage print out from http://airgunexpress.com/Accessories/ referencing various level devices.
Webpage print out from http://secure.armorholdings.com/b-square/smarthtml/about.html referencing background on B-Square and their firearm accessories.
Webpage print out from http://secure.armorholdings.com/b-square/tools_scope.html referencing scope and site tools offered by B-Square.
Webpage print out from www.battenfeldtechnologies.com/113088.html referencing a level device.
Webpage print out from www.battenfeldtechnologies.com/wheeler referencing products from Wheeler Engineering.
Webpage print out from www.blackanddecker.com/laserline/lasers.aspx referencing Black & Decker's Auto-Leveling Lasers.
Webpage print out from www.laserlevel.co.uk/newsite.index.asp referencing the laser devices available on the Laserlevel Online Store.
Shooting Illustrated "Update on the .25 SAUM" Jul. 2005 pp. 14-15.

* cited by examiner

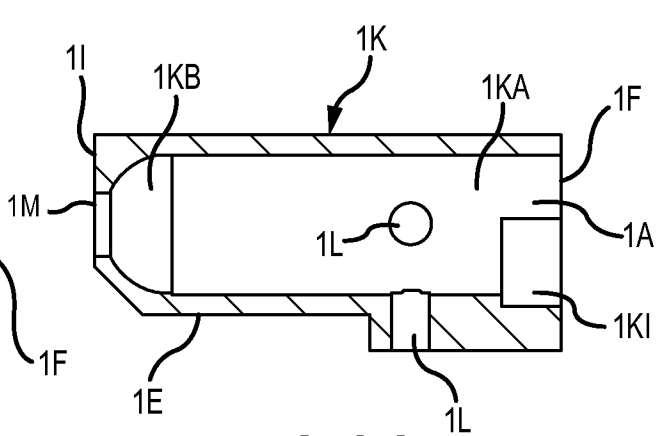
FIG.2A
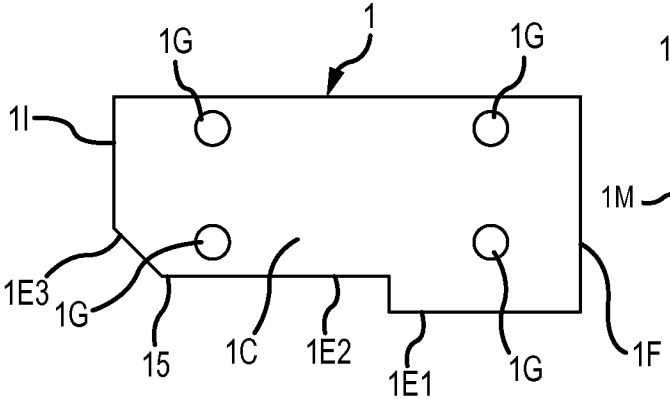
FIG.2B
FIG.2C
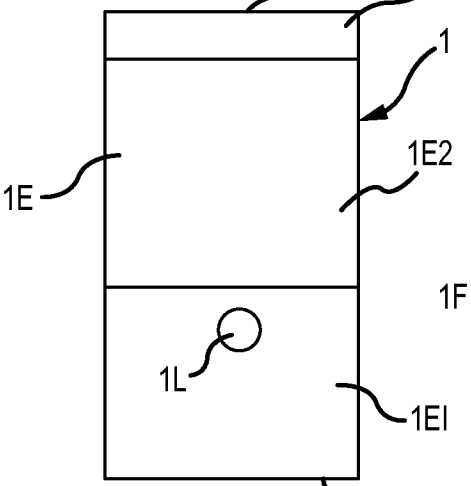
FIG.2D
FIG.2E
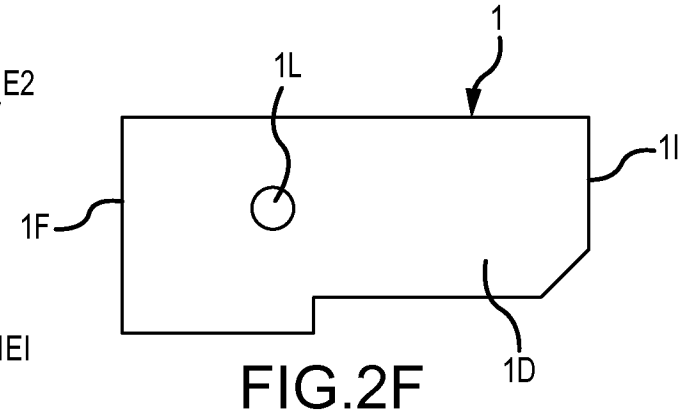
FIG.2F

MASTER MODULE LIGHT SOURCE, RETAINER AND KITS

BACKGROUND OF THE INVENTION

There are many known devices used as laser sighters for weapons, particularly pistols. It has, however, been difficult to develop a suitable laser sighter for small pistols (such as those that fit into one's pocket) because there is very little available space on the side or top of the gun to mount a laser, and mounting it to a trigger guard can be difficult plus the laser can be jarred out of position. Moreover, mounting a laser in any of the above positions on a small pistol may make the assembled pistol and laser hard to conceal, or fit within a pocketbook or pocket, which defeats its purpose.

Therefore, for these applications the laser has typically been mounted in a casing (preferably made of plastic) positioned in front of the trigger guard in order to minimize the additional size of the assembled device. The problem, however, is that for virtually every make and model of gun, a different laser assembly configuration is required because of the different gun configuration. Hence, a manufacturer may require to manufacture and inventory, and dealers may have to inventory, dozens (or more) of different laser assembly/casing units to fit each type of small pistol. This increases manufacturing and inventory carrying costs. Plus, there is a greater possibility that the manufacturer or dealer will have too much of one type of laser assembly/casing unit and not enough of another.

SUMMARY OF THE INVENTION

The present invention solves these and other problems by making one universal laser unit (also called a "master module") that incorporates a laser, a power source (such as one or more batteries), a control unit that controls the operation of the laser (which has one or more switches), and a laser adjustment mechanism, into one, fully-assembled, compact unit that can fit into any casing designed for virtually every type of small pistol. With this single laser unit (also called a "combination unit" or "unit"), a manufacturer and dealer only need to stock this single unit. Further, this unit is preferably attached using a single fastener to a casing that fits on a small pistol. In summary, a unit according to the invention greatly reduces assembly, manufacturing and inventory time and expense for the manufacturer, inventory expense for the dealer, and makes assembly easy for an end user (which is often the gun owner).

The laser unit is shown in the appended drawings and some specific examples of the invention are set forth below. In a preferred embodiment, a two-piece laser unit casing (preferably made of hard plastic), also called a combination unit casing, unit casing or casing, is provided. A fully-assembled laser unit according to the invention is attached to one side of the casing, preferably by a single fastener, so mounting it is easy. The laser unit preferably is received in a cavity in the casing where it is supported and subject to limited shock and movement.

After the laser unit is attached to one side of the casing, the entire casing is assembled to the pistol. This is done in a manner known to those skilled in the art. The two pieces of the casing are pressed together and have a recess that receives the front part of the trigger guard. Once pressed together, the laser unit is held snuggly in a cavity formed by both casing pieces, and the two pieces of the casing are fastened tightly together, such as by using two threaded fasteners with corresponding nuts. This pulls the two pieces of the casing together tightly on the front of the trigger guard, and the pieces also form a groove that mates against the bottom of the gun barrel in front of the trigger guard to help make a snug fit.

Once fully assembled onto a gun, the casing has an aperture for laser light to emanate out from the laser unit, two other openings to allow access to laser adjustment fasteners (one to adjust the laser in the up-and-down directions and the other to adjust it side to side), and an opening to provide access to a battery cap to allow the battery(ies) or other power source to be changed without opening the casing.

A laser unit according to the invention could be, for example, sold separately (with the casings also sold separately), could be sold assembled into a casing, or could be sold as a kit with multiple casings that fit multiple, different pistols.

BRIEF DESCRIPTION OF THE DRAWINGS

FIGS. 2A-2F are views of a housing used in the master module of FIG. 1.

DETAILED DESCRIPTION OF PREFERRED EMBODIMENTS

Figure 1:
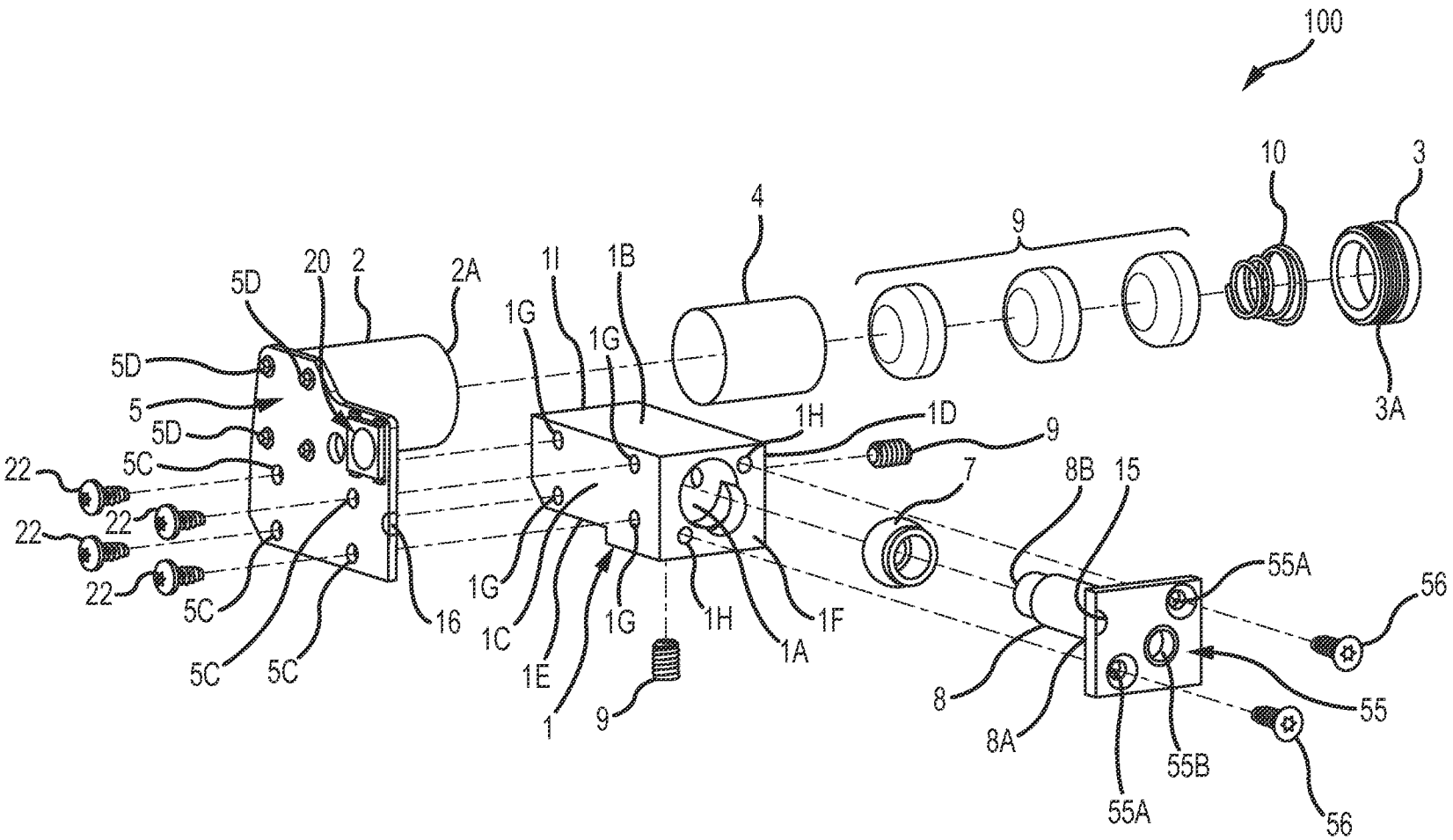
FIG. 1 is an exploded view of a master module according to aspects of the invention.

Turning now to the drawings where the purpose is to describe preferred embodiments of the invention and not to limit same, FIG. 1 shows an exploded view of a laser module (also called a combined unit, or master module) 100. Combined unit 100 is configured to be compact and to provide a laser sighter for various types of small pistols. Combined unit 100 can reduce manufacturing and inventory costs because it can be used in place of multiple laser modules, each having different configurations.

Combined unit 100 has a laser module housing 1. Housing 1 is preferably made of metal, such as aluminum, or plastic, such as an electrically conductive plastic. Any suitable material, however, may be used to form laser module housing 1. Laser module housing 1 has a cavity 1A for receiving a module cushion ball 7 and laser module 8. Laser module housing has a top 1B, a first side 1C, a second side 1D, a bottom 1E (with portions 1E1, 1E2 and 1E3), a front 1F, and a back 1I. Side 1C has apertures 1G for mounting housing 1 to module mount board 5.

The bottom 1E of laser module 1E is stepped with a first part 1E1, a second part 1E2 and an angled end 1E3 that connects to side 1I. Side 1I has an opening 1M through which laser light 1M through which laser light can be emitted.

Opening 1A leads to a cavity 1K that has a first portion 1KA and a second portion 1KB (that retains module cushion ball 7. Bottom portion 1E1 includes an opening 1L that receives a set screw 9. Side 1D also includes an opening 1L that accepts a set screw 9. Side 1D also includes an opening 1L that accepts a set screw 9. When laser module 8 and cushion ball 7 are positioned in cavity 1K, set screws 9 can be tightened or loosened to reposition laser module 8 in cavity 1K.

Laser module 8 has a first end 8A that connects to PCB 55 in communication with opening 55B and a second end 8B that includes a lens through which laser light is emitted.

Module mount board 5 serves the purpose of being structural and including circuitry that directs power from power source 9 though circuit board 55 to laser module 8. Module mount board 5 has a rear side 5A and a front side 5B. A tactile dome switch 20 is attached to module mount board 5. Switch 20 has a compressive portion 20A (as shown it is on both sides 5A and 5B) that, when compressed, activates the circuitry to transfer power from power source 9 to laser module 8. When pressure is released from switch 20 preferably power is no longer transferred to laser module 8.

Module mount board 5 also includes openings 5C that align with openings 1G. Screws 22 are then positioned through openings 5C and received in openings 1G to retain module housing 1 to module mount board 5, and circuit board 55 is pressed into communication with the circuitry on module mount board 5 by contact 4416 being in contact with contact 1G.

Battery casing 2 is tubular and hollow to receive insulating sleeve 4 and power source 9, which is shown is three batteries preferably of type 3V photo cell batteries. Sleeve 4 is positioned in the opening of battery casing 2 and batteries 9 are positioned inside of sleeve 4. Biasing spring 10 is positioned between batteries 9 and battery cap 3. Battery cap 3 has a threaded end 3A that is received in a threaded portion of the inner wall of battery casing 2, and an outer surface 3B with a slot 3D for being turned by a screwdriver.

Circuit board 55 has a through hole 55B that preferably has a plated inner surface and a spring (not shown) soldered therein, wherein the spring transfers negative energy. Opening 1A and cavity 1K have a recess 1K1 that helps allow laser module 8 to be moved by set screws 9 if required. Circuit board 55 also has openings 55A that align with openings 1H in housing 1. Fasteners 56 pass through openings 55A and are received in openings 1H to retain circuit board 55 to housing 1, and fasteners 56 preferably transfer positive energy.

Figure 3A:
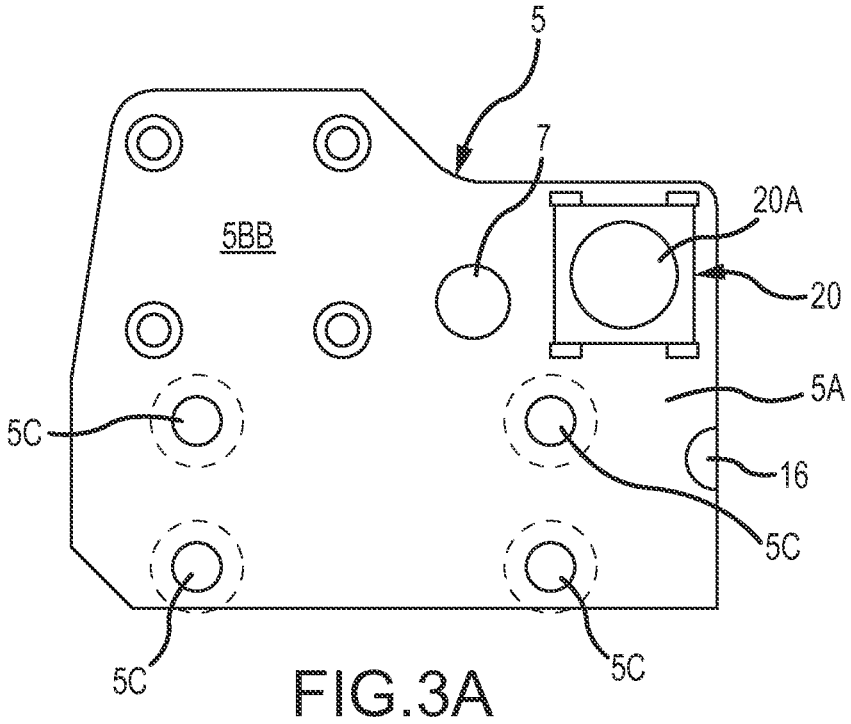
FIGS. 3A-3B are back and front views, respectively of a module mount board used in the master module of FIG. 1.
Figure 3B:
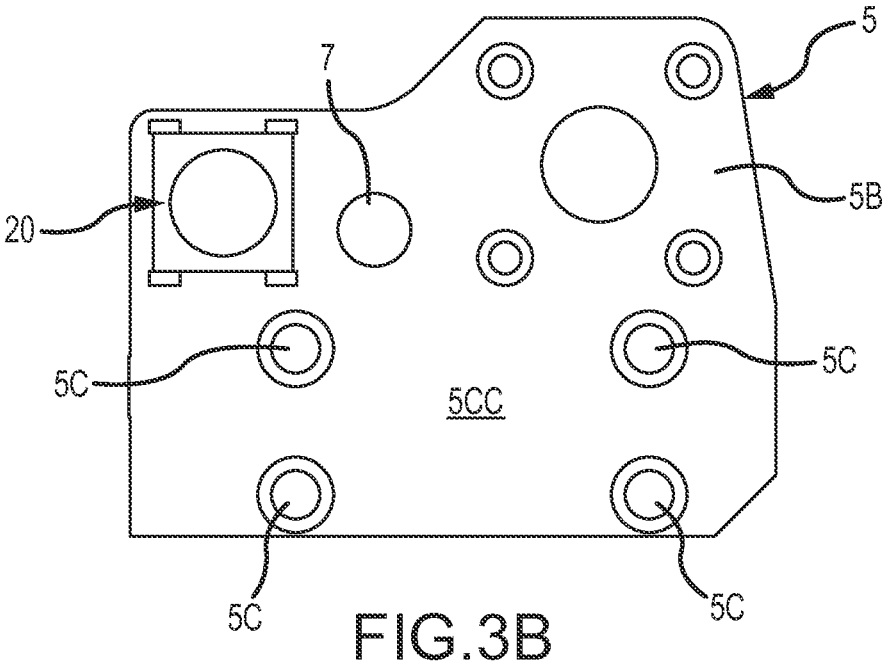
Figure 6:
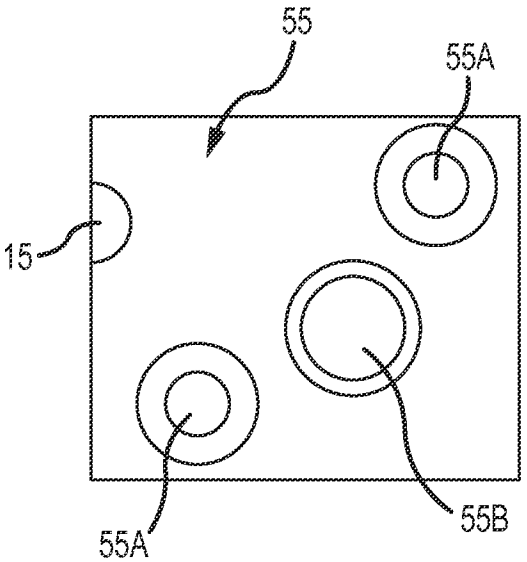
FIG. 6 is a front view of the circuit board used in the master module of FIG. 1.
Figure 5:
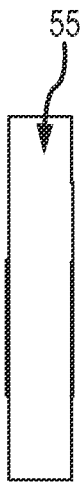
FIG. 5 is a side view of the circuit board used in the master module of FIG. 1.
Figure 4:
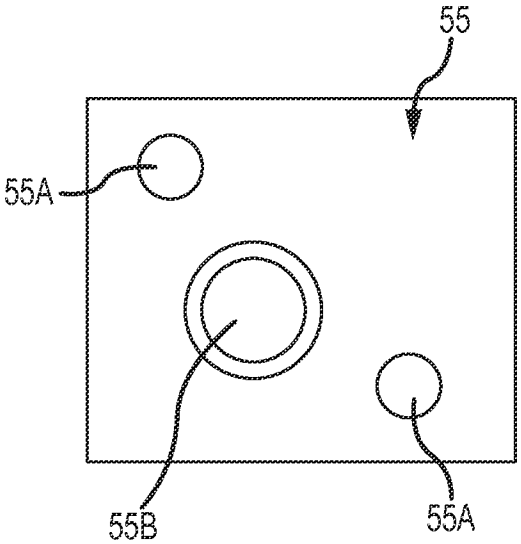
FIG. 4 is a back view of a circuit board used in the master module of FIG. 1.
Figure 8:
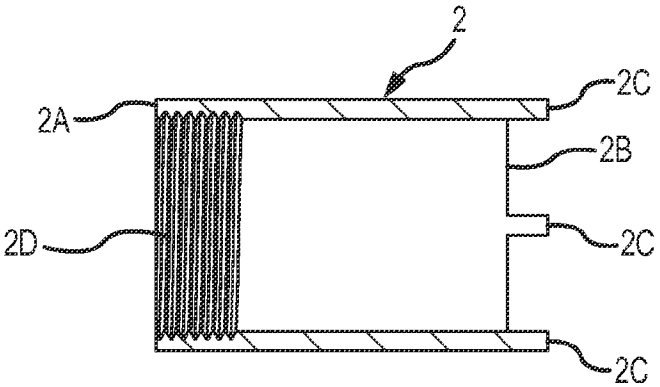
FIG. 8 is a cross-sectional, side view of a battery casing used in the master module of FIG. 1 showing internal threads.
Figure 10:
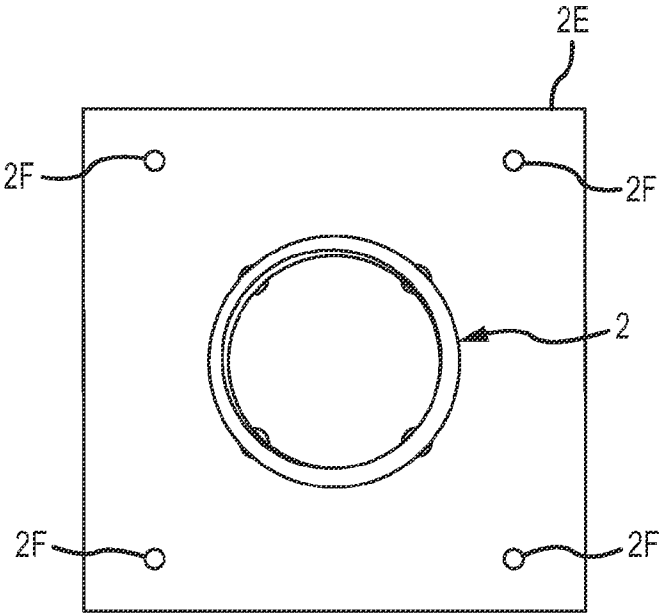
FIG. 10 is a rear view of a battery casing used in the master module of FIG. 1 with the battery casing attached to a connection plate.

FIGS. 2A-2F show various views of housing 1. FIGS. 3A and 3B show, respectively, the back surface 5BB and front surface 5CC of module mount board 5. Opening 7 is for receiving a fastener to connect combined unit 100 to a casing that mounts on a gun. FIGS. 4-6 show, respectively a back view, side view, and front view of circuit board 55.

Figure 7:
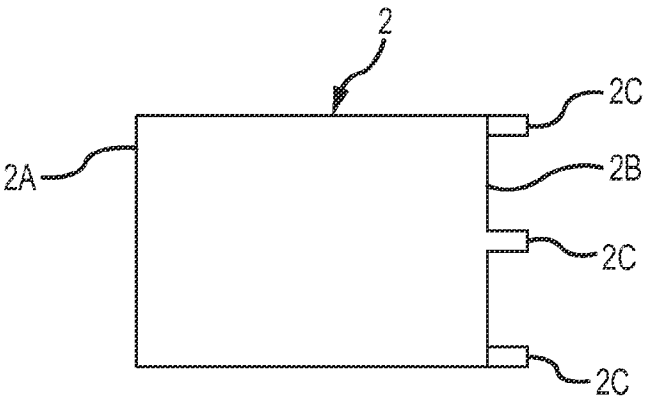
FIG. 7 is a side view of a battery casing used in the master module of FIG. 1.
Figure 9:
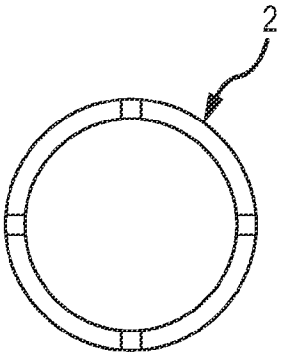
FIG. 9 is a front view of a battery casing used in the master module of FIG. 1.

FIG. 7 is a side view of battery casing 2 with a front end 2A through which insulation sleeve 4 and batteries 9 are inserted. Back end 2B includes a multiple (and preferably four) stems 2C to attach casing 2 to plate 2E, which is attached to module mount 5 utilizing openings 2F to be attached utilizing fasteners 5D. Threads 2D align with and receive threads 3A on cap 3.

Figure 13:
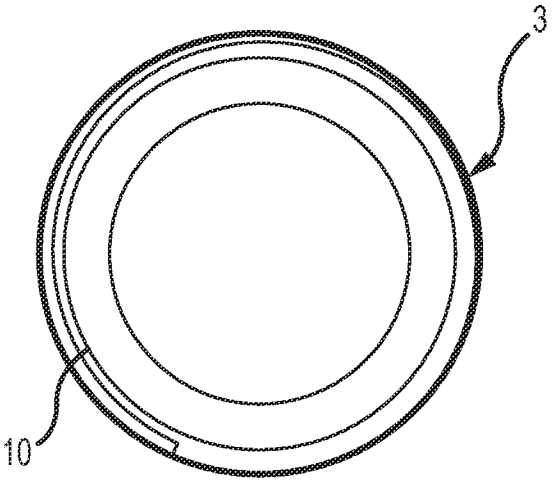
FIG. 13 is a front view of a battery cap used in the master module of FIG. 1.
Figure 12:
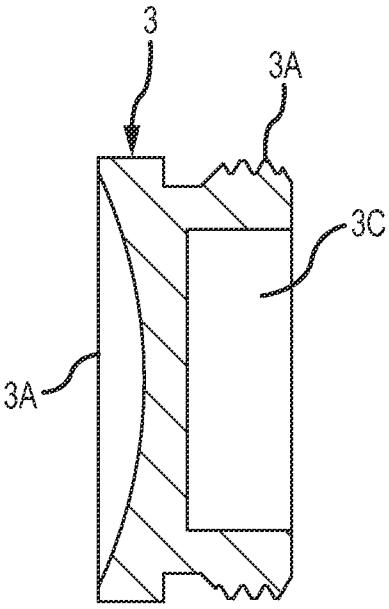
FIG. 12 is a side, cross-sectional view of a battery cap used in the master module of FIG. 1.
Figure 11:
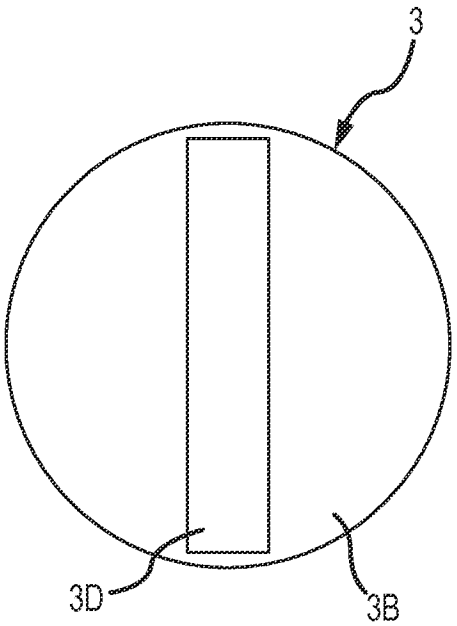
FIG. 11 is a rear view of a battery cap used in the master module of FIG. 1.
Figure 14:
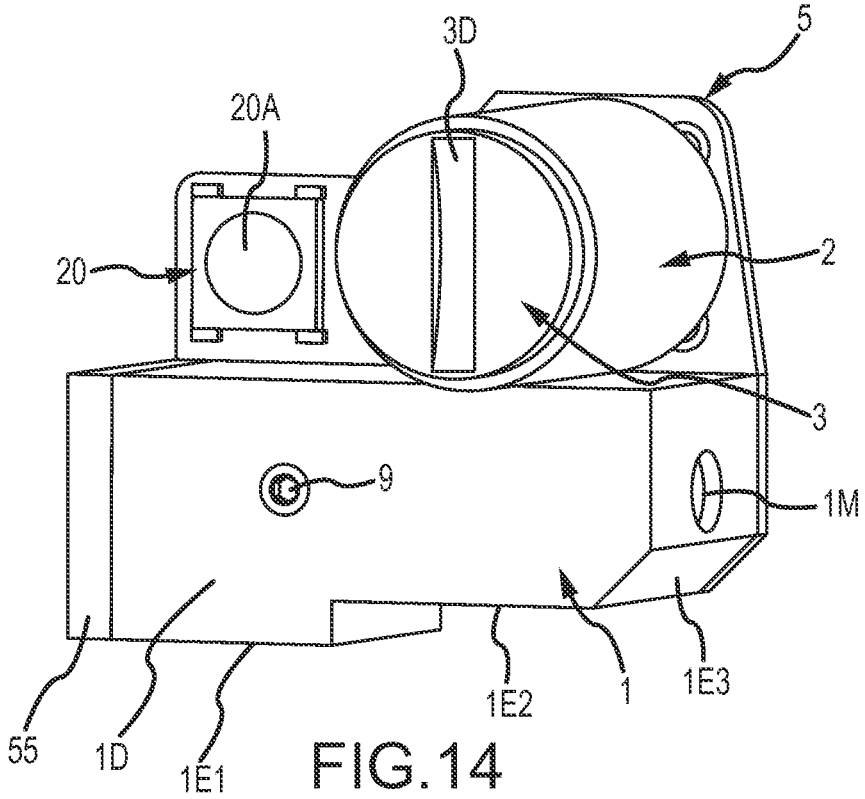
FIG. 14 shows a perspective, side view of a fully assembled master module according to aspects of the invention.
Figure 15:
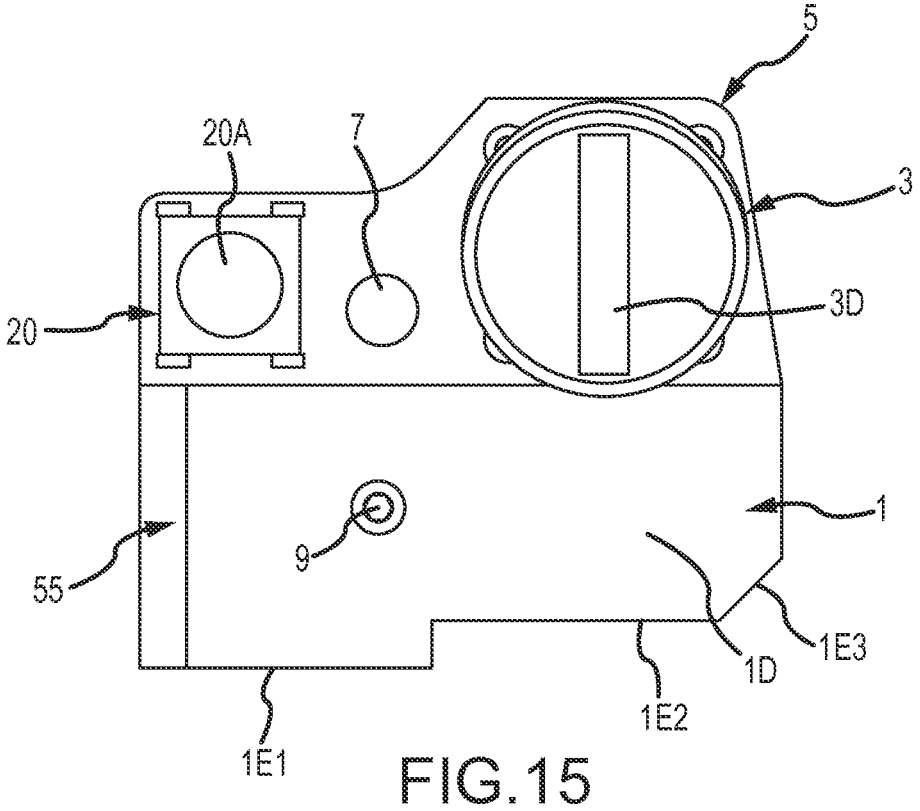
FIG. 15 is a front view of the master module of FIG. 14.
Figure 16:
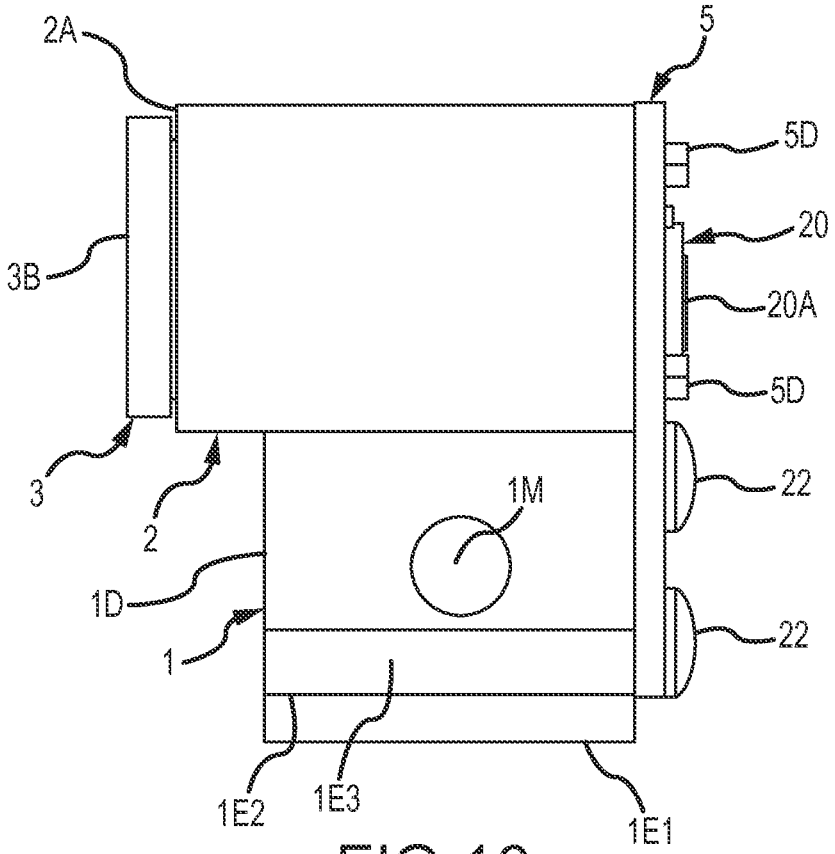
FIG. 16 is a side view of the master module of FIG. 14.
Figure 17:
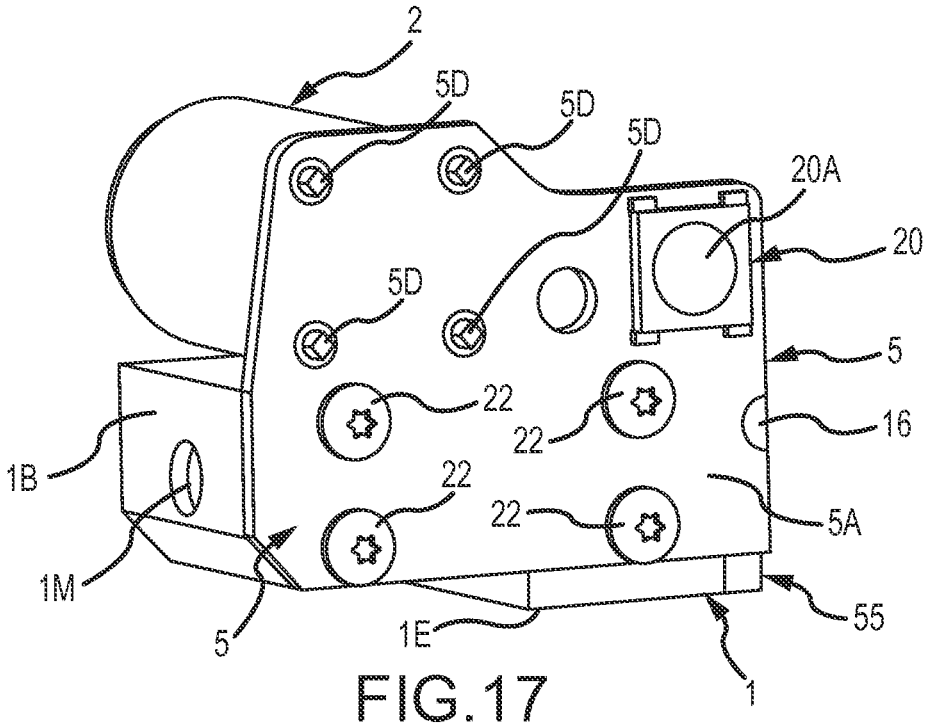
FIG. 17 is a back, perspective view of the master module of FIG. 14.
Figure 18:
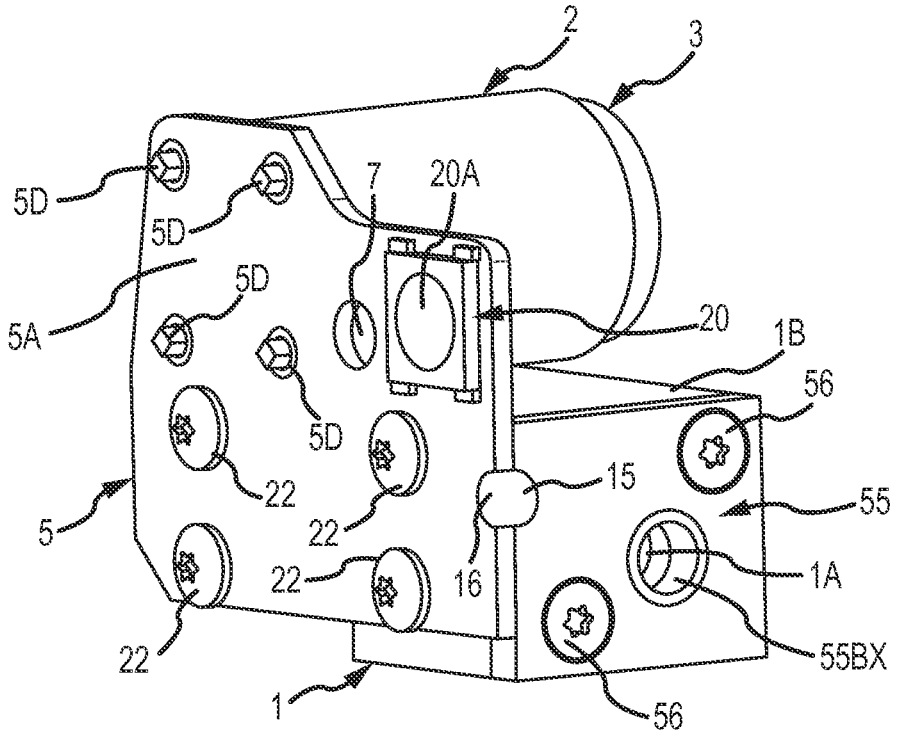
FIG. 18 is an opposite back, perspective view of the master module of FIG. 14.
Figure 19:
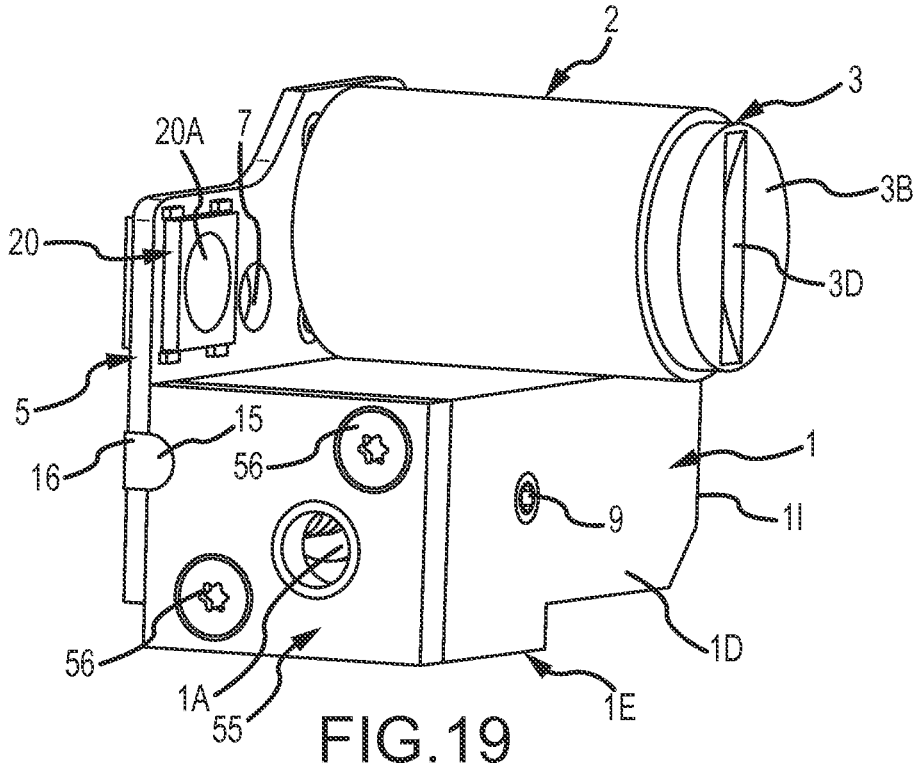
FIG. 19 is a side, perspective view of the master module of FIG. 14.
Figure 20:
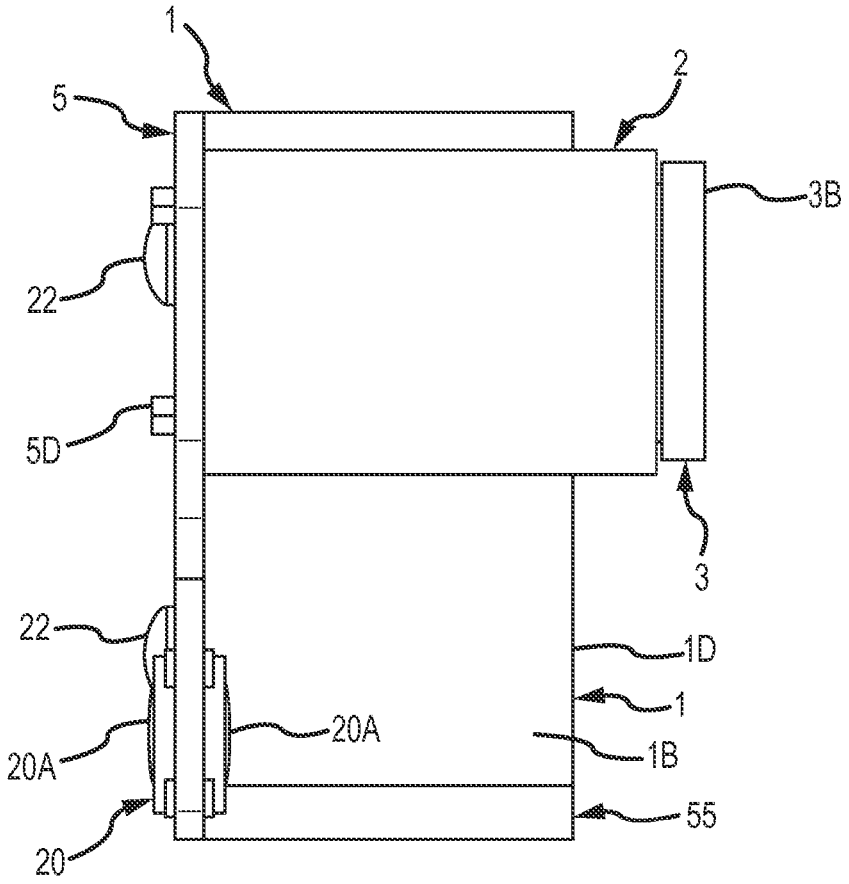
FIG. 20 is a top view of the master module of FIG. 14.
Figure 21:
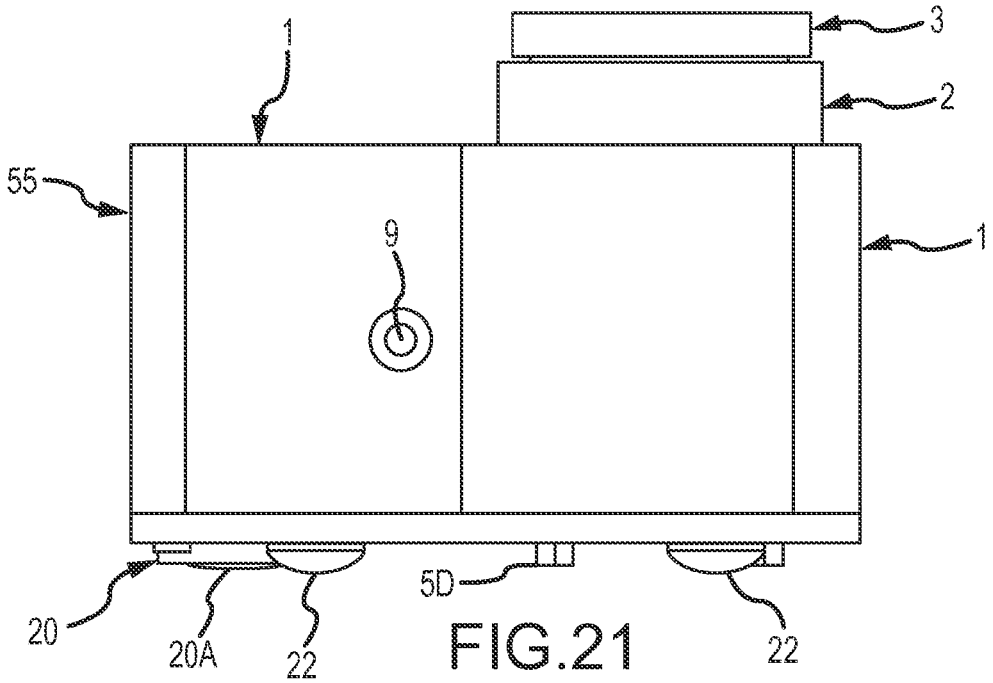
FIG. 21 is a bottom view of the master module of FIG. 14.
Figure 22:
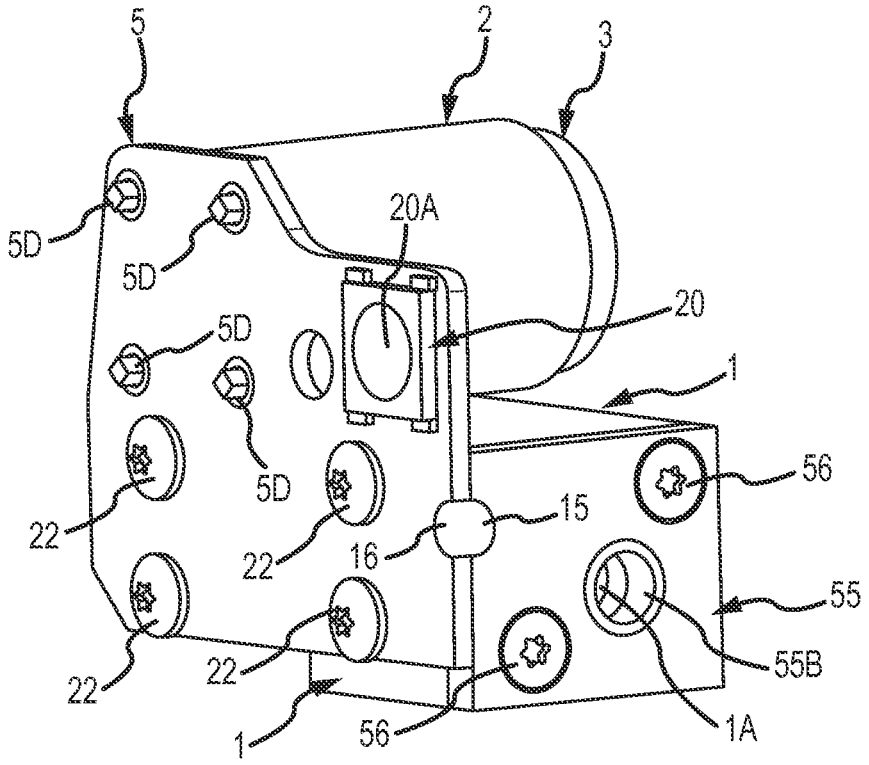
FIG. 22 is another back, perspective view of the master module of FIG. 14.

FIGS. 11-13 depict cap 3. FIG. 11 is a rear view, FIG. 12 is a cross-sectional side view, and FIG. 13 is a front view with spring 10 pressed into cavity 3C.

FIGS. 14-22 show a fully assembled master module according to aspects of the invention.

Figure 23:
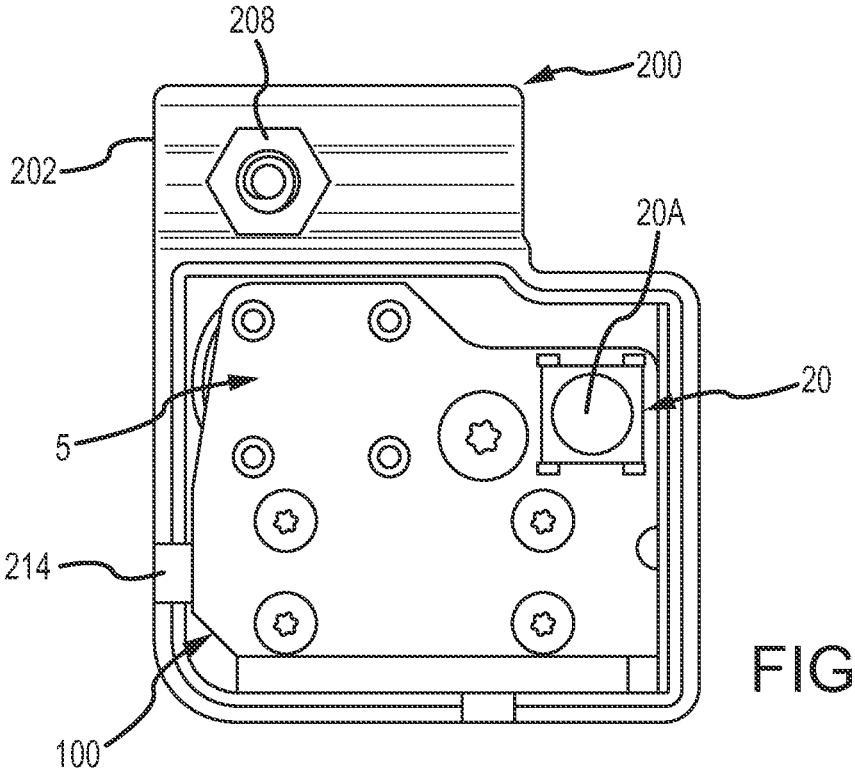
FIG. 23 shows a master module according to aspects of the invention mounted in a casing that can be mounted to a picatinny rail of a gun.
Figure 24:
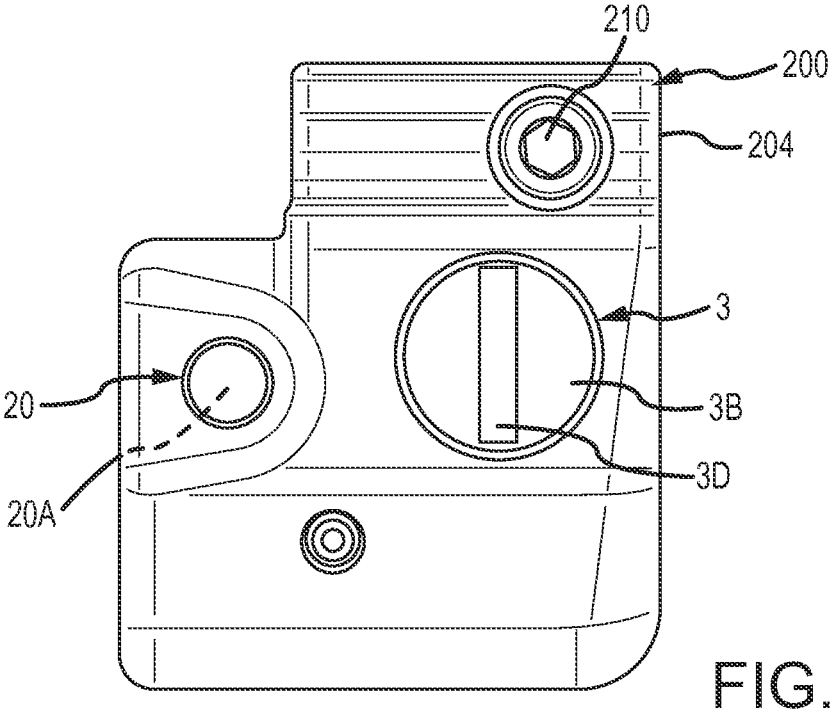
FIG. 24 shows the opposite side of the structure of FIG. 23.
Figure 25:
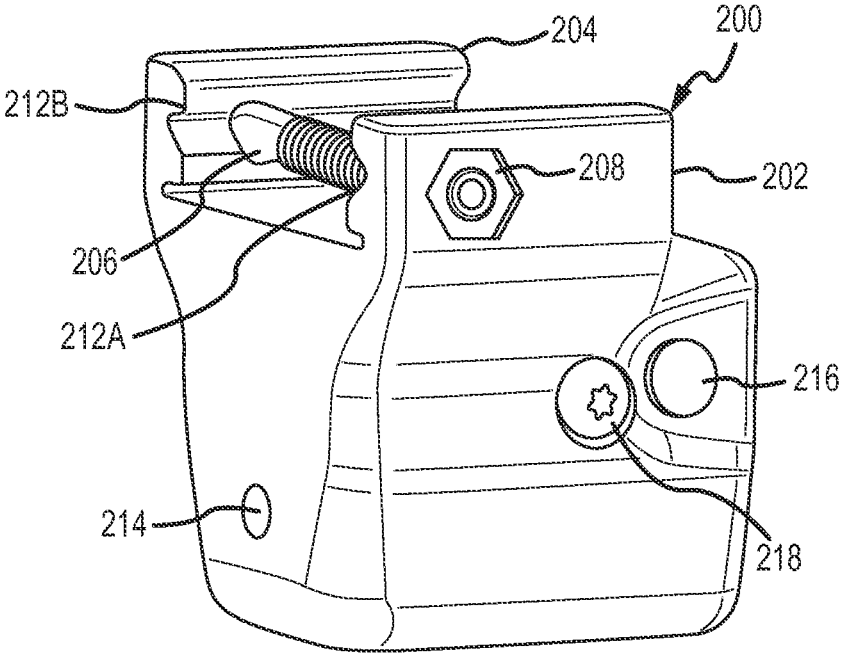
FIG. 25 shows a front, perspective view of the structure of FIGS. 23-24.

FIGS. 23 and 24 show the fully assembled master module according to FIGS. 14-22 positioned in a casing 200 that can be mounted on picatinny rail of a pistol. FIG. 25 shows a perspective view of casing 200.

FIG. 23 shows a combined unit 100 positioned in a casing 200 that has a top portion configured to mount on the 200 picatinny rail of a gun. In this view the casing 200 is open to show combined unit 100 therein. FIG. 24 shows the opposite side of the casing 200 with the casing closed. Fastener 208 is used to close the top portion snuggly on a picatinny rail. 214 is an opening in canister 200 through which laser light can be emitted. FIG. 25 shows canister 200 in a side, perspective view. Rail 202, with groove 212A and rail 204, with groove 212B, can be tightened (using bolt 206 and nut 208) to a picatinny rail. Fastener 218 helps retain module 100 in casing 200 and button 216 changes the condition of module 100.

Figure 26:
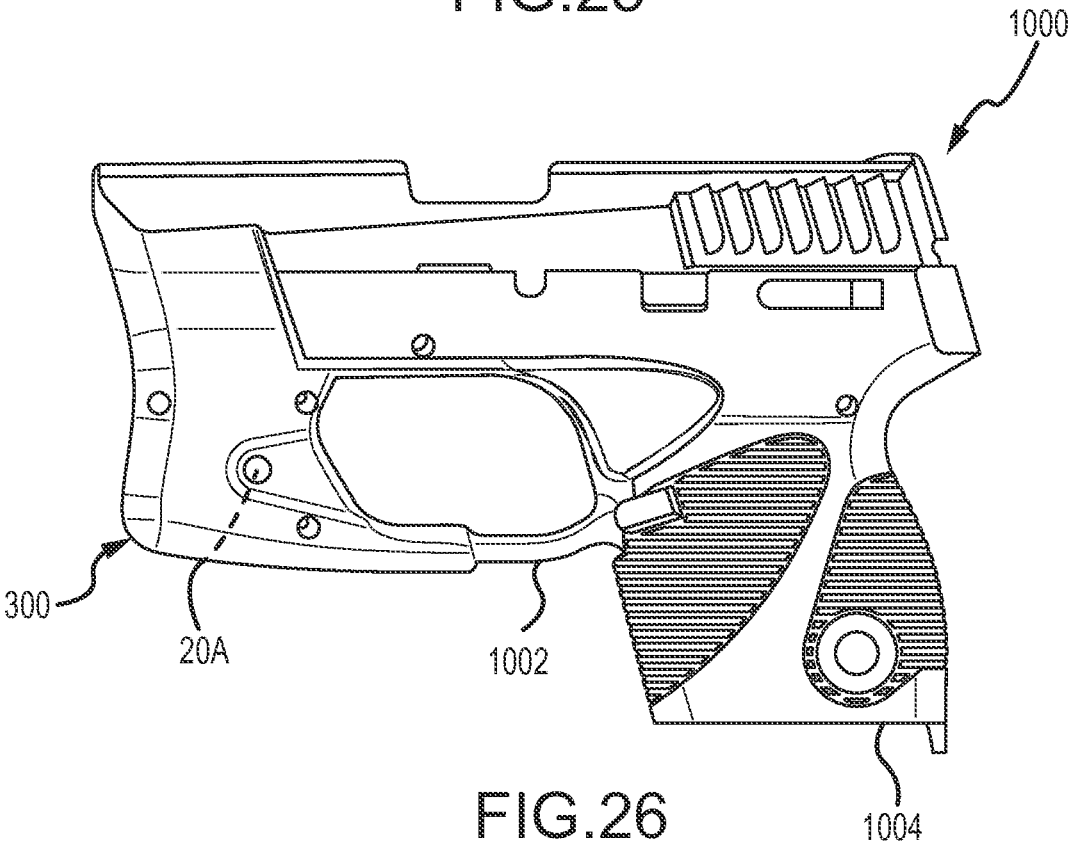
FIG. 26 shows a gun including a master module according to aspects of the invention.
Figure 27:
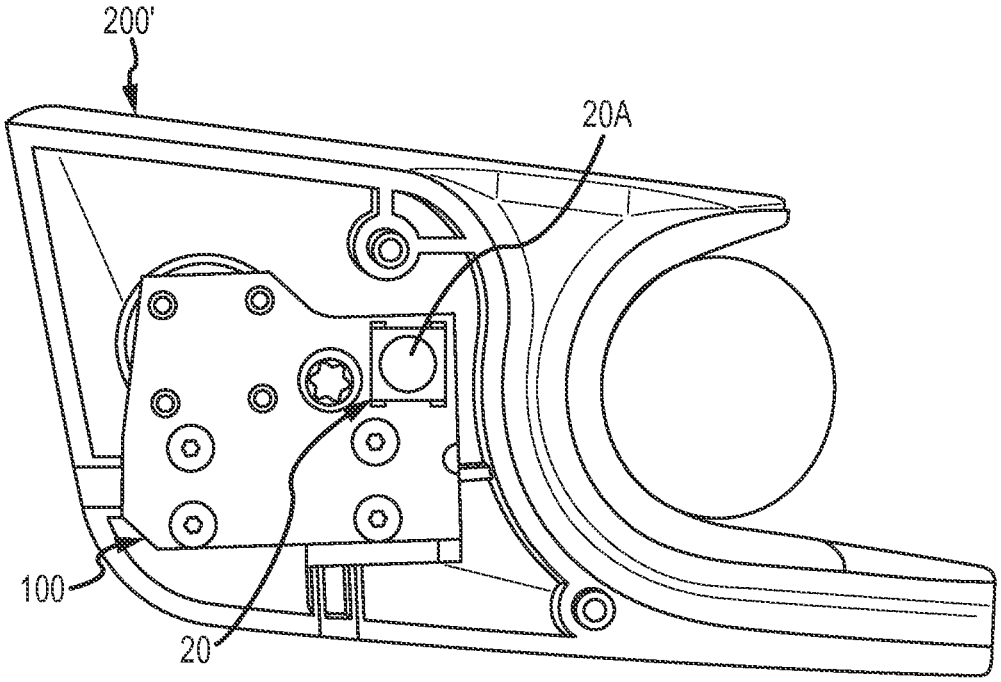
FIG. 27 shows a close-up, partial view of the gun of FIG. 26 with the casing side removed to expose the master module.
Figure 28:
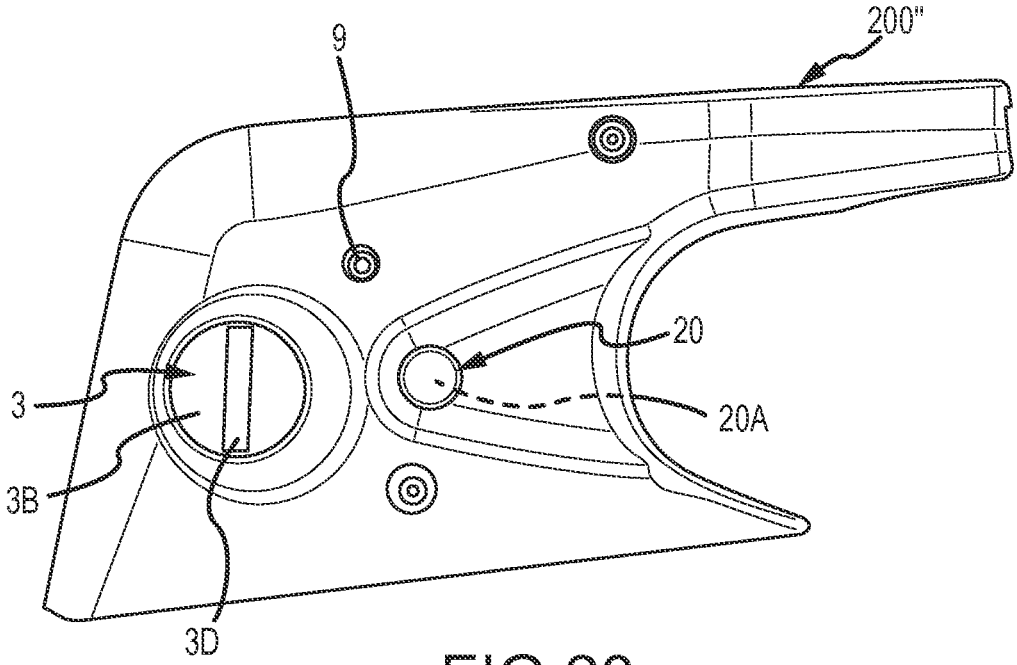
FIG. 28 shows a side view of a casing including a master module according to the invention.

FIG. 26 shows another canister configuration 300 for fitting a different gun 1000 that utilizes a combined unit 100. Gun 1000 has a trigger guard 1002, a grip 1004, and a top portion 1006. FIG. 27 is another canister 200' that is open to show the placement of combined unit 100 therein. FIG. 28 shows another canister 200' that utilizes a combined unit 100.

Figure 29:
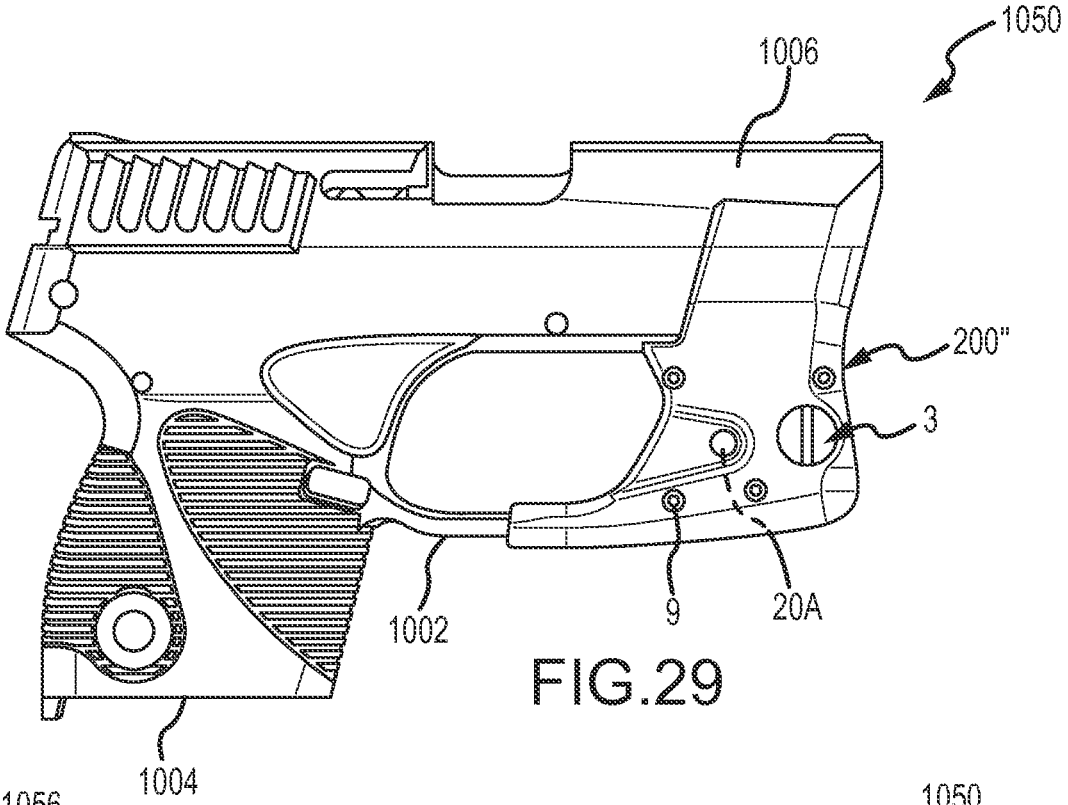
FIG. 29 is a side view of a gun including a casing having a master module in accordance with aspects of the invention.
Figure 30:
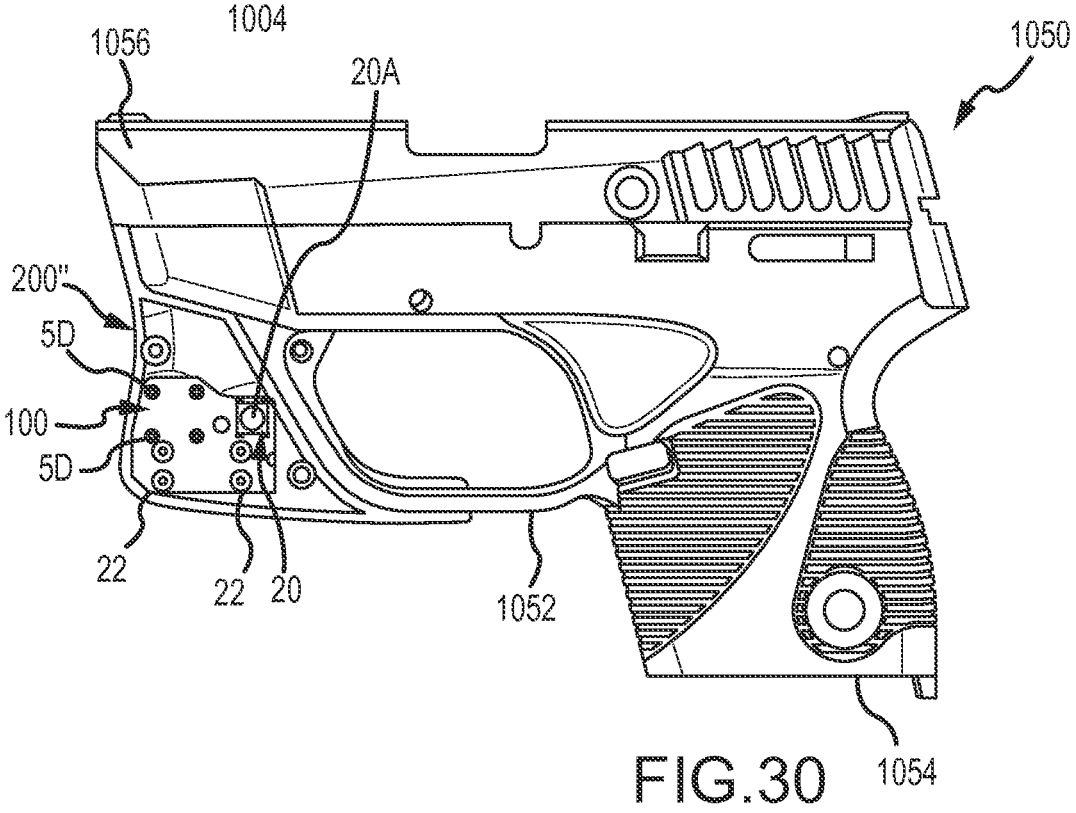
FIG. 30 shows the opposite side of the gun of FIG. 29 with part of the casing removed.

FIGS. 29-30 show a gun 1050 having a trigger guard 1052, a grip 1054, and top portion 1056. Gun 1050 utilizes the canister 200' of FIG. 28 and combined unit 100.

Figure 31:
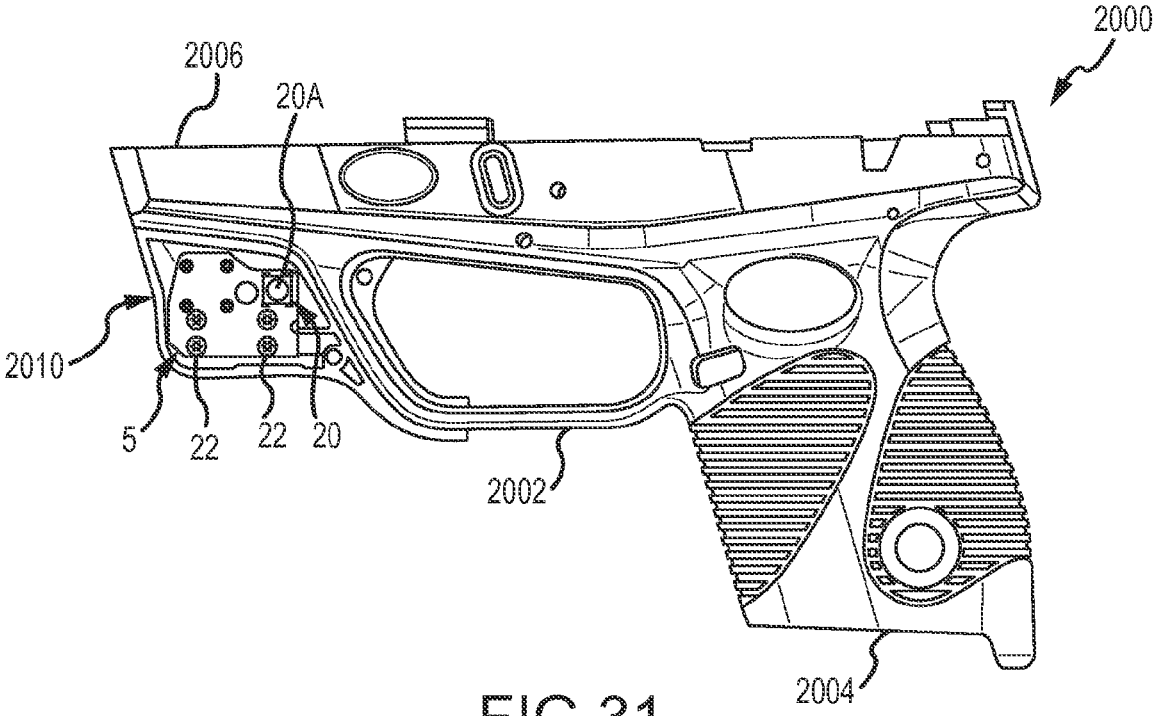
FIG. 31 shows another gun with the casing open to show a master module according to aspects of the invention.
Figure 32:
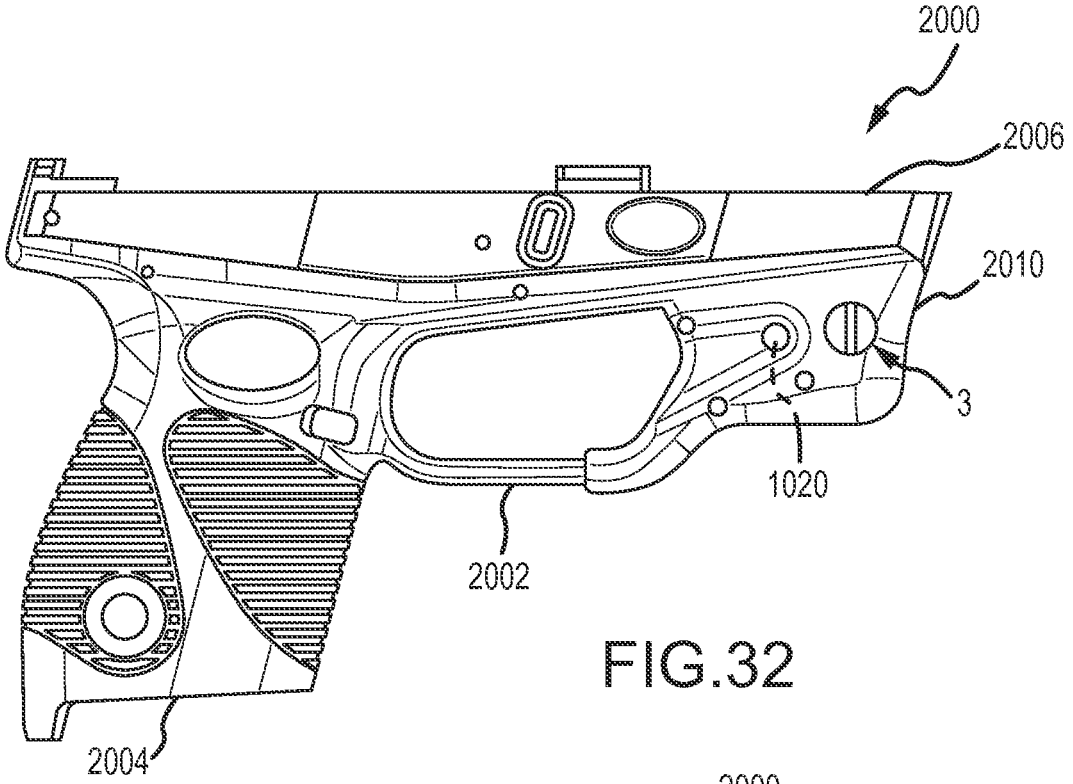
FIG. 32 shows one side of the gun of FIG. 31 including a casing with a master module in accordance with aspects of the invention.
Figure 33:
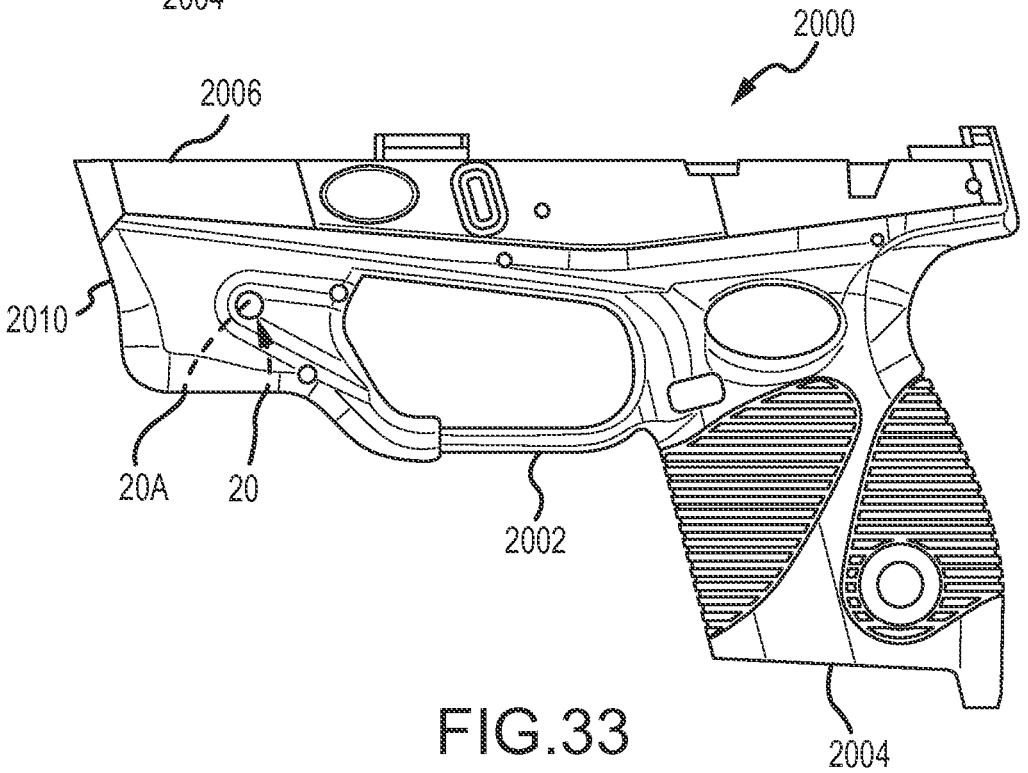
FIG. 33 shows the opposite side of the gun in FIG. 32.
Figure 34:
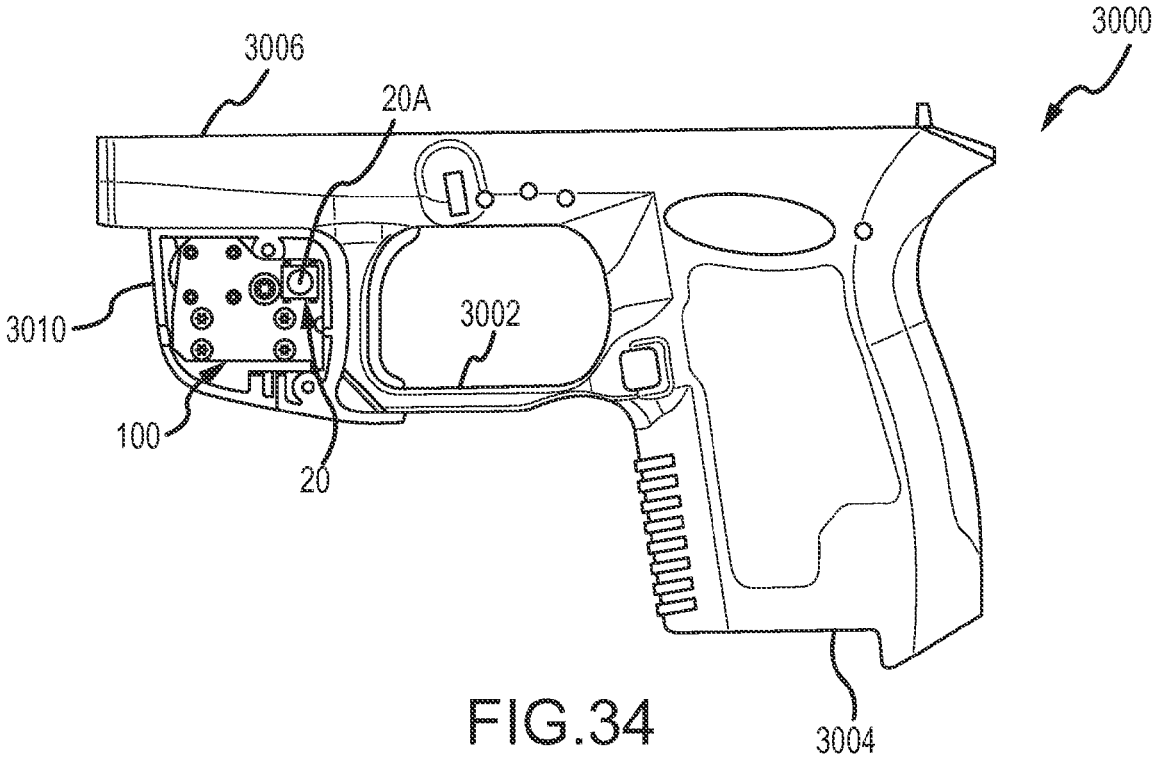
FIG. 34 shows a side view of an alternate gun with a casing open to show a master module in accordance with aspects of the invention.
Figure 35:
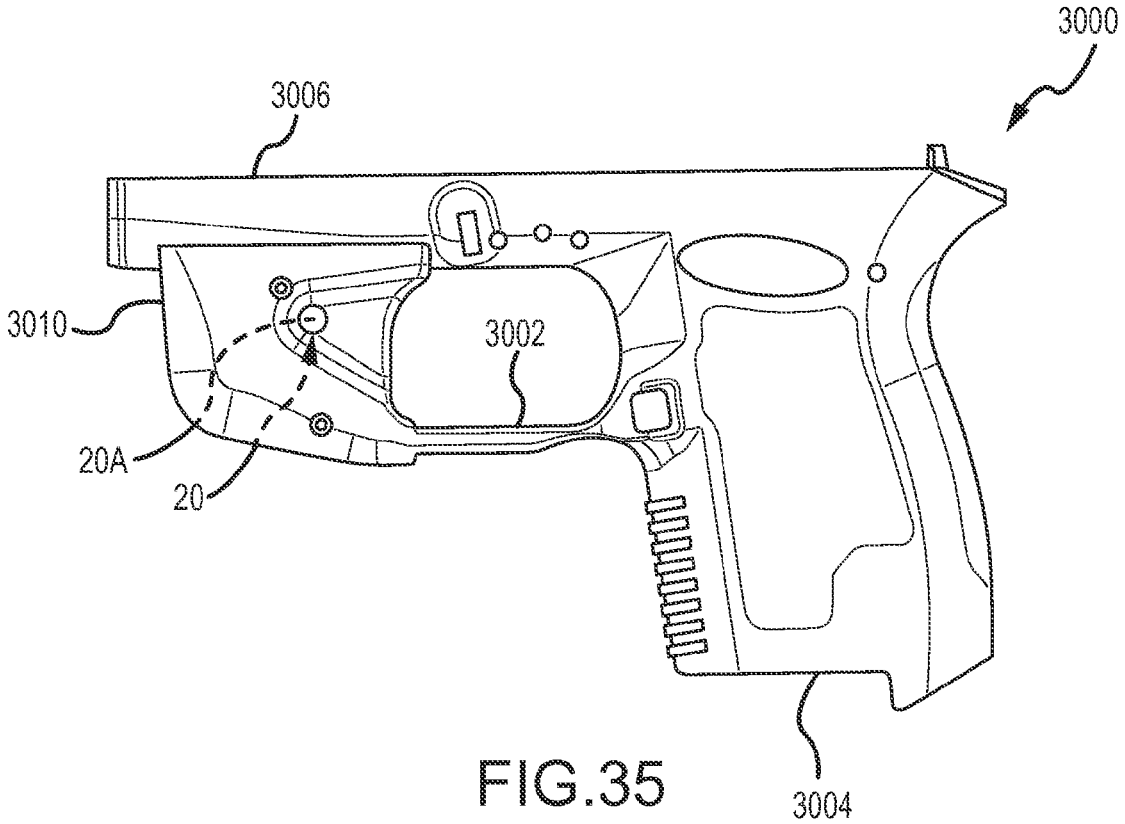
FIG. 35 shows the gun of FIG. 34 with the casing enclosing the master module.

FIGS. 31-33 show a gun 2000 with a canister 2010 including a combined unit 100 according to the invention. FIGS. 34-35 show a gun 3000 having a trigger guard 3002, a grip 3004, and a top portion 3006. A cannister 3010 including a combined unit 100 according to the invention is retained in cannister 3010.

Some specific examples of the invention follows:

1. A combined unit for providing (a) a light source wherein the light source has a first control position wherein it emits light and a second control position wherein it does not emit light, (b) a power source, and (c) a control device to control the power provided to the light source, wherein the light source has a casing and is positioned in a block housing, the block housing having an opening aligning with a lens of the light source to enable light to be emitted outward from the block housing, and at least one surface to which at least part of the control device is mounted.
2. The unit of example 1 wherein the control device is a first circuit board and a second circuit board in electrical communication with the first circuit board.
3. The unit of example 2 wherein the second circuit board is at a right angle to the first circuit board.
4. The unit of either of examples 2 or 3 wherein the first circuit board has an electrical contact on an edge and the second circuit board has an electrical contact on an edge and the respective contacts touch to form an electrical connection when the unit is assembled.
5. The unit of example 4 wherein the electrical contacts are soldered together.
6. The unit of any of examples 2-5 wherein the second circuit board has a through bolt hole in communication with an end of the light source opposite its lens.
7. The unit of example 6 wherein the through bolt hole is plated.
8. The unit of example 7 or 8 wherein a spring is retained in the through bolt hole.
9. The unit of example 8 wherein the spring is soldered in the through bolt hole.
10. The unit of example 8 or 9 wherein the spring biases the light source away from the spring.
11. The unit of any of examples 8-10 wherein the spring provides a negative contact for the light source.
12. The unit of any of examples 1-11 wherein the block housing is comprised of a conductive material.
13. The unit of any of examples 2-11 wherein the second circuit board is connected to the block housing.
14. The unit of example 2 wherein the second circuit board is connected to the block housing by fasteners, the block housing is comprised of a conductive material and the fasteners provide a positive charge to the light source.
15. The unit of example 1 wherein power from the power source travels through the first circuit board to reach the light source.
16. The unit of example 15 wherein power from the power source travels through the first circuit board and second circuit board to reach the light source.
17. The unit of any of examples 1-16 wherein the light source is a laser.
18. The unit of any of examples 2-17 wherein the material block has at least two sides and the first circuit board is connected to one of the sides and the second circuit board is connected to another of the sides.
19. The unit of any of examples 1-18 wherein the power source is in a casing that is connected to the first circuit board.
20. The unit of any of examples 1-19 wherein the power source is one or more batteries.
21. The unit of any of examples 1-20 wherein the material block includes a plurality of openings that extend from an outside surface of the material block to the light source casing, wherein one opening aligns with the lens of the light source, and two of the openings are each configured to receive an adjustment device capable of moving the light source within the material block.
22. The unit of example 21 wherein each adjustment device is a set screw.
23. The unit of example 21 or 22 wherein one of the adjustment devices moves the light source from side to side and the other adjustment device moves the light source up and down.
24. The unit of any of examples 1-23 that is configured to cause the light source to operate in any of the following modes: stay constantly on, stay constantly off, blink, or turn from the on position to the off position after a predetermined period of time.
25. The unit of any of examples 1-24 that includes one or more switches to change the mode of operation of the light source.
26. The unit of example 25 wherein the one or more switches is on the first circuit board or the control device.
27. The unit of any of examples 2-26 wherein the first circuit board is attached to one side of the material block, the battery casing is attached to the first circuit board, and extends outward over a top of the material block.
28. The unit of any of examples 1-27 wherein the material block is comprised of aluminum.
29. The unit of any of examples 1-28 wherein the power source is three batteries.
30. The unit of any of examples 1-29 wherein the power source is enclosed in a casing.
31. The unit of any of examples 1-30 wherein the power source is surrounded by an insulating sleeve.
32. The unit of example 30 wherein the casing includes a cap on its end for removing and replacing the power source.
33. The unit of any of examples 1-32 wherein the light source has a first end through which light is emitted and the first end is retained in a module cushion ball inside the material block.
34. A unit casing mountable to a firearm, the casing including a cavity that receives and provides weather protection to a unit of any of examples 1-33.
35. The unit casing of example 34 that is formed of plastic.
36. The unit casing of example 34 or 35 that is formed in two pieces.
37. The unit casing of any of examples 34-36 that forms a channel that retains the front of a trigger guard of a gun.
38. The unit casing of any of examples 34-37 that, when assembled, has an opening that aligns with the lens on the light source to permit light to emit therefrom, has an opening to allow access to a side-to-side adjustment mechanism that adjusts the position of the light source, has an opening to allow access to an up-and-down adjustment mechanism that adjusts the position of the light source, and an opening to permit access to a battery cap, so that the power source may be removed and replaced.
39. The unit casing of any of examples 34-38 that is configured to fit on a part of a pistol between the front portion of the trigger guard and the lower surface of the barrel in front of the trigger guard.

40. A kit comprising a plurality of unit casings of different sizes and a combination unit of any of claims 1-33 that is not positioned in any unit casing, but is configured to be positioned in any one of the unit casings.
41. The kit of example 40 that has two unit casings.
42. The kit of example 40 that has one combination unit.
43. The kit of example 40 that has more than two unit casings and one combination unit.
44. The kit of example 40 that has more than two unit casings, and more than one combination unit wherein there are fewer combination units than unit casings.
45. The unit casing of any of examples 34-39 wherein the unit is attached to the casing by a single fastener.
46. The unit casing of example 45 that has two parts and the unit is attached to one of the two parts.
47. The kit of any of examples 40-44 wherein the unit is connected to the unit casing by a single fastener.
48. The unit casing of any of examples 34-39 or 45-46 that has a switch button on either side wherein each of the switch buttons is in contact with a respective switch on the first circuit board or the control device.
49. The kit of any of examples 40-44 or 47 wherein each of the casings includes one long switch button and one short switch button wherein each switch button is configured to contact a respective switch on the combination unit when the casing is assembled with the combination unit inside.
50. The unit of example 2 or 3 wherein the second circuit board is in electrical communication with the block housing.
51. A casing including a combination unit of any of examples 1-33, the casing configured to fit on the picatinny rail of a gun.
52. The casing of example 1 that has two rail grasping members and a threaded fastener therebetween, the fastener capable of being tightened to pull the grasping members towards one another and tighten them to the picatinny rail.
53. The combined unit of example 1 wherein the control source is a plurality of circuit boards.
54. The combined unit of example 53 wherein each of the circuit boards is connected to the block housing.
55. The unit casing of any of examples 34-38, 45-46 or 48 that includes one long switch button and one short switch button wherein each switch button is configured to contact a respective switch on the combination unit when the casing is assembled with the combination unit inside.

Having thus described preferred embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A combined unit for providing (a) a light source wherein the light source has a first control position wherein it emits light and a second control position wherein it does not emit light, (b) a power source, and (c) a control device to control the power provided to the light source, wherein the light source has a casing and is positioned in a block housing, the block housing having an opening aligning with a lens of the light source to enable light to be emitted outward from the block housing, and at least one surface to which at least part of the control device is mounted;

wherein the control device is a first circuit board and a second circuit board in electrical communication with the first circuit board;

wherein the first circuit board has an electrical contact on an edge and the second circuit board has an electrical contact on an edge and the respective contacts touch to form an electrical connection when the unit is assembled;

wherein the electrical contacts are soldered together;

wherein the second circuit board has a through bolt hole in communication with an end of the light source opposite its lens;

wherein the through bolt hole is plated; and wherein a spring is retained in the through bolt hole.

2. The unit of claim 1 wherein the second circuit board is at a right angle to the first circuit board.

3. The unit of claim 1 wherein the spring is soldered in the through bolt hole.

4. The unit of claim 1 wherein the spring biases the light source away from the spring.

5. The unit of claim 1 wherein the spring provides a negative contact for the light source.

6. The unit of claim 1 wherein the block housing is comprised of a conductive material.

7. The unit of claim 1 wherein the second circuit board is connected to the block housing.

8. The unit of claim 1 wherein the second circuit board is connected to the block housing by fasteners, the block housing is comprised of a conductive material and the fasteners provide a positive charge to the light source.

9. The unit of claim 1 wherein power from the power source travels through the first circuit board to reach the light source.

10. The unit of claim 9 wherein power from the power source travels through the first circuit board and second circuit board to reach the light source.

11. The unit of claim 1 wherein the light source is a laser.

12. The unit of claim 1 wherein the block housing has at least two sides and the first circuit board is connected to one of the sides and the second circuit board is connected to another of the sides.

13. The unit of claim 1 wherein the power source is in a casing that is connected to the first circuit board.

14. The unit of claim 1 wherein the power source is one or more batteries.

15. The unit of claim 1 wherein the block housing includes a plurality of openings that extend from an outside surface of the block housing to the light source casing, wherein one opening aligns with the lens of the light source, and two of the openings are each configured to receive an adjustment device capable of moving the light source within the block housing.

16. The unit of claim 15 wherein each adjustment device is a set screw.

17. The unit of claim 15 wherein one of the adjustment devices moves the light source from side to side and the other adjustment device moves the light source up and down.

18. The unit of claim 1 that is configured to cause the light source to operate in each of the following modes: stay constantly on, stay constantly off, blink, or turn from the on position to the off position after a predetermined period of time.

19. The unit of claim 1 that includes one or more switches to change the mode of operation of the light source.

20. The unit of claim 19 wherein the one or more switches is on the first circuit board or the control device.

* * * * *